US006429729B2

(12) United States Patent
Kobayashi et al.

(10) Patent No.: US 6,429,729 B2
(45) Date of Patent: Aug. 6, 2002

(54) SEMICONDUCTOR INTEGRATED CIRCUIT DEVICE HAVING CIRCUIT GENERATING REFERENCE VOLTAGE

(75) Inventors: Mako Kobayashi; Fukashi Morishita; Mihoko Akiyama; Yasuhiko Taito; Akira Yamazaki; Nobuyuki Fujii, all of Hyogo (JP)

(73) Assignees: Mitsubishi Denki Kabushiki Kaisha; Mitsubishi Electric Engineering Company Limited, both of Tokyo (JP)

( * ) Notice: Subject to any disclaimer, the term of this patent is extended or adjusted under 35 U.S.C. 154(b) by 0 days.

(21) Appl. No.: 09/758,273

(22) Filed: Jan. 12, 2001

(30) Foreign Application Priority Data

Jun. 12, 2000 (JP) ..... 2000-174712

(51) Int. Cl.[7] ..... G05F 1/10
(52) U.S. Cl. ..... 327/540; 327/308
(58) Field of Search ..... 327/308, 525, 327/530, 534, 535, 537, 538, 540, 541, 542, 543, 545, 546

(56) References Cited

U.S. PATENT DOCUMENTS 5,450,030 A * 9/1995 Shin et al. ..... 327/525
5,459,684 A * 10/1995 Nakamura et al. ..... 365/149
5,473,277 A * 12/1995 Furumochi ..... 327/543
5,767,732 A * 6/1998 Lee et al. ..... 327/525
5,838,076 A * 11/1998 Zarrabian et al. ..... 307/115
5,973,548 A * 10/1999 Ukita et al. ..... 327/540
6,140,862 A * 10/2000 Hagura ..... 327/537
6,144,248 A * 11/2000 Oosugi et al. ..... 327/525
6,166,589 A * 12/2000 Park ..... 327/540
6,255,895 B1 * 7/2001 Kim et al. ..... 327/530
6,281,734 B1 * 8/2001 McClure et al. ..... 327/308

FOREIGN PATENT DOCUMENTS

JP 11-194838 7/1999

* cited by examiner

*Primary Examiner*—Jeffrey Zweizig
(74) *Attorney, Agent, or Firm*—McDermott, Will & Emery

(57) ABSTRACT

A semiconductor integrated circuit device includes a reference voltage generating circuit that can be tuned without a circuit replacement when a process condition is varied. The reference voltage generating circuit is constituted such that two different circuit configurations having different temperature properties are switched by a first switch. In each of the circuit configurations, a switch control circuit in which tuning can be performed by switching a second switch generates a control signal based on a test mode and supplies the signal to the first switch for tuning. Thereafter, a fuse in the switch control circuit is blown off to generate a control signal, and reference voltage Vref is output.

4 Claims, 24 Drawing Sheets

FIG. 6

| ENSA (ENMA) | STOP | TUNE | |
|---|---|---|---|
| L | H | L | INTERNAL GENERATION STOP |
| H | H | H | TMODE = H |
| H | L | H | TMODE = L |
| H | L | L | NORMAL OPERATION MODE |

FIG. 12

| TUNE M | TMODE | | | MSW1 | /MSW1 | MSW2 | /MSW2 |
|---|---|---|---|---|---|---|---|
| L | L | → | NORMAL OPERATION STATE | — | — | — | — |
| L | H | → | TUNING MODE | 2Vtp + R(2) TYPE | ON | OFF | B | ON |
| H | L | → | TUNING MODE | 1Vtp + R TYPE | ON | OFF | A | OFF |
| H | H | → | TUNING MODE | 2Vtp + R TYPE | OFF | ON | A | OFF |

FIG. 17 PRIOR ART

| TUNING STEP | SW1 | SW2 | SW3 | SW4 |
|---|---|---|---|---|
| 1 | ON | ON | ON | ON |
| 2 | OFF | ON | ON | ON |
| 3 | ON | OFF | ON | ON |
| 4 | OFF | OFF | ON | ON |
| 5 | ON | ON | OFF | ON |
| 6 | OFF | ON | OFF | ON |
| 7 | ON | OFF | OFF | ON |
| 8 | OFF | OFF | OFF | ON |
| 9 | ON | ON | ON | OFF |
| 10 | OFF | ON | ON | OFF |
| 11 | ON | OFF | ON | OFF |
| 12 | OFF | OFF | ON | OFF |
| 13 | ON | ON | OFF | OFF |
| 14 | OFF | ON | OFF | OFF |
| 15 | ON | OFF | OFF | OFF |
| 16 | OFF | OFF | OFF | OFF |

SEMICONDUCTOR INTEGRATED CIRCUIT DEVICE HAVING CIRCUIT GENERATING REFERENCE VOLTAGE

BACKGROUND OF THE INVENTION

1. Field of the Invention

The present invention relates to a semiconductor integrated circuit device, and in particular to a configuration generating an optimal voltage in accordance with variation of process conditions.

2. Description of the Background Art

In order to reduce the power consumption of a semiconductor integrated circuit device, it is effective to lower an operating power-supply voltage. This is because, when the operating power-supply voltage is lowered, charging/discharging current of a load capacitance is reduced by the amount of the reduction of the voltage. Thus, as the power-supply voltage is lowered, the power consumption is reduced in proportional to the square of the reduction rate of the voltage.

For example, in a widely-used general-purpose memory, the gate length of a transistor is scaled down to near the limit of micro-fabrication, and an internal power potential of a memory is down-converted by an on-chip voltage down converter while a general-purpose LSI (Large Scale Integration) and an external power-supply voltage are kept equal to each other. This can realize high reliability and low power consumption. Further, by the voltage down converter, a constant internal power potential can also be obtained, and hence a stable operation can be realized without being affected by variation of the external power-supply voltage.

A conventional voltage down converter is now described with reference to FIG. 16. Sub-voltage down converter shown in FIG. 16 includes a constant-current generating circuit 3, a reference voltage generating circuit 4A and a current mirror amplifier 5.

Constant-current generating circuit 3 generates a signal ICONST and a signal BIAS. Constant-current generating circuit 3 generates a stable internal voltage compared to an external voltage, and yet has a circuit configuration capable for keeping a temperature variation of the system to be minimum. Constant-current generating circuit 3 includes transistors TrP-1, TrP-2, TrN-1 and TrN-2, and a resistor Rt. Transistors TrP-1 and TrP-2 are PMOS transistors, whereas transistors TrN-1 and TrN-2 are NMOS transistors.

Transistor TrP-1 is connected between a power-supply voltage and a node ICONST. Resistor Rt and transistor TrP-2 are connected in series between the power supply voltage and node BIAS. The respective gates of transistors TrP-1 and TrP-2 are connected to node ICONST. Transistor TrN-1 is connected between node ICONST and a ground voltage, and transistor TrN-2 are connected between node BIAS and a ground voltage. The respective gates of transistors TrN-1 and TrN-2 are connected to node BIAS. A signal ICONST is output from node ICONST, and a signal BIAS is output from node BIAS.

Transistors TrN-1 and TrN-2 are formed as transistors having the same size and either of the gates is connected to node BIAS, such that the same current I flows on the transistors TrP-1 and TrN-1 side, and the transistors TrP-2 and TrN-2 side.

Transistors TrP-1 and TrP-2 are formed to have the gate lengths L equal to each other and the gate widths W with a ratio of 1:10. A voltage difference ΔV which is made upon a voltage drop, generated when the same current flows in both transistors, is converted into current I (=ΔV/Rt). Because resistance Rt requires a large value on the order of several hundred kΩ, an interconnection resistance obtained by adjusting the length of gate interconnection materials of the transistor may be used.

Transistors TrP-1 and TrP-3 are formed to have the same size, so that current I is transmitted to the reference voltage generating circuit. At the same time, feed back is provided for the current flowing at transistors TrP-1 and TrP-1 side and at transistors TrP-2 and TrN-2 side. This feed back effect enables the system to transfer an optimal constant current I to the reference voltage generating circuit while monitoring the state of output all the time.

Reference voltage generating circuit 4A includes transistors TrC-1 to TrC-5, TrP-3, and TrP-4. Transistor TrP-3 is connected between a power-supply voltage and a node Vref outputting a reference voltage Vref, and receives signal ICONST at the gate thereof Transistors TrC-5, TrC-1, TrC-2, TrC-3 and TrC-4 are connected in series between node Vref and a node Z0, the respective gates thereof being grounded. Transistor TrP-4 is connected between node Z0 and a ground potential, the gate thereof being grounded.

Switches SW1 to SW4 are respectively arranged for transistors TrC-1 to TrC-4. When a switch SWi (i=1 to 4) is turned on, the drain and the source of a transistor TrC-i are connected.

A channel resistance including transistors TrC-1 to TrC-4 and TrC-5 are denoted by Rc. (I×Rc+Vtp) is output as a reference voltage Vref, which is a sum of a potential difference I×Rc at channel resistance Rc receiving current I and a potential difference Vtp, substantially corresponding to a threshold voltage of transistor Trp-4, at transistor TrP-4 generated when current I flows. The threshold of transistor TrP-4 is hereinafter referred to as Vtp.

Current mirror amplifier 5 includes a main amplifier 1 having a large driving power operated when an internal circuit driven by an output Int.Vcc is activated, and a sub-amplifier 2 having a small driving power which is constantly operated.

Main amplifier 1 includes PMOS transistors TrP-10, TrP-11, Ti and T5, and NMOS transistors TrN-3, TrN-10 and TrN-11. Sub-amplifier 2 includes PMOS transistors TrP-10, TrP-11 and T2, and NMOS transistors TrN-3, TrN-10 and TrN-11.

Main amplifier 1 is now described. Transistor TrP-10 is connected between a power-supply voltage and a node COMPA, and transistor TrP-11 is connected between a power-supply voltage and a node Z11, and the respective gates of transistors TrP-10 and TrP-11 are connected to a node Z11.

Transistor TrN-10 is connected between node COMPA and a node Z12, and receives reference voltage Vref at the gate thereof. Transistor TrN-11 is connected between node Z11 and node Z12, and the gate thereof is connected to a node OUT outputting an internal power-supply voltage int.Vcc. Transistor TrN-3 is connected between node Z12 and a ground voltage, and receives an activation signal ACT for making the gate to operate the internal circuit.

Transistor T1 is connected between the power-supply voltage and node COMPA, and receives activation signal ACT at the gate thereof. Transistor T5 is connected between the power-supply voltage and node OUT, and the gate thereof is connected to node COMPA.

Sub-amplifier 2 is now described. A connecting node of transistors TrP-10 and TrP-11 is referred to as a node COMPS. Transistors TrP-10, TrP-11, TrN-10, TrN-11 and TrN-3 are connected as described above. Transistor TrN-3 in sub-amplifier 2 receives signal BIAS output from constant-current generating circuit 3. Transistor T2 is connected between the power-supply voltage and node OUT, and the gate thereof is connected to node COMPS.

An amplifier is an important circuit determining the driving power of the system, and a constant-current generating circuit and a reference voltage generating circuit are greatly important for minimizing variation of an internal potential for a change of a temperature or an external voltage, and are very delicate for changes of various conditions. The properties of the constant-current generating circuit and the reference voltage generating circuit determine the operational property of the system.

In reference voltage generating circuit 4A, channel resistance Rc is formed from a transistor having a long gate length. To generate a desired reference voltage Vref independent of variation in a resistance value for a threshold due to process variation, combinations of on/off of switches SW1 to SW4 can change the value of channel resistance Rc in 16 stages.

If the ratio of the gate length of transistors TrC-1 to TrC-4 is made to be TrC-1: TrC-2: TrC-3: TrC-4=1:2:4:8, voltage tuning in 16 stages can be performed at almost regular intervals. By assuming that the output reference voltage Vref varies between ±10–20% for a set value due to a process change, the circuit is made such that the output voltage can be adjusted to the set value as long as the variation is in the above range.

Considering the property of the system, reference voltage Vref desirably has low dependencies on an external voltage and a temperature.

As for the external voltage dependency, resistance Rt, channel resistance Rc and threshold Vtp have potential differences in accordance with constant current I. Therefore, reference voltage Vref tends to have no direct voltage dependency. Further, it should be appreciated the external voltage dependency is low in the first place in the reference voltage generating circuit, since the potential difference ΔV is independent of a voltage as described above.

The temperature dependency is subsequently described. As for the temperature dependency of each material, when the temperature rises from 27° C. to 87° C., resistance Rt (gate interconnection material) and channel resistance Rc are increased by approximately 10%, and threshold Vtp is decreased by approximately 10%. Further, because of the temperature dependencies of transistors TrP-1 and TrP-2, the potential difference ΔV is increased by approximately 20%. Therefore, current I determined by ΔV/Rt is also increased.

These values are applied, for example, to constant-current generating circuit 3 and reference voltage generating circuit 4A. The tuning steps in 16 stages and on/off of switches SW1 to SW4 in each step have relations shown in FIG. 17.

Assuming that external voltage 3.3V generates a reference voltage 2V. As shown in FIG. 18, a voltage of 1.5V to 2.3V is generated at a room temperature of 27° C., whereas a voltage of 1.5V to 2.7V is generated at a high temperature of 100° C. This means that an I×Rc component is increased as a tuning step goes higher. Thus, it can be seen that a positive temperature dependency is increased.

As an alternative example of a reference voltage generating circuit, a reference voltage generating circuit 4B is shown in FIG. 19. Reference voltage generating circuit 4B includes, in addition to the configuration of reference voltage generating circuit 4A, a PMOS transistor TIP-5. Transistor TrP-5 is connected between transistors TrC-4 and TrP-4. The threshold of transistor TrP-5 is substantially the same as threshold Vtp of transistor TrP-4.

In reference voltage generating circuit 4B, a threshold component of the transistor is made to be 2×Vtp. The ratio of threshold Vtp with a negative temperature dependency is increased compared to that of the component with positive temperature dependency (I×Rc). Therefore, as shown in FIG. 20, no temperature dependency exists near the middle stage of the tuning steps, i.e., near the tuning step 8, either at the room temperature 27° C. or the high temperature 100° C. However, the positive or negative temperature dependency appears at both ends of the tuning steps (tuning step 1 or 16).

As an alternative example of a reference voltage generating circuit, a reference voltage generating circuit 4C is shown in FIG. 21. Reference voltage generating circuit 4C includes the same components as the ones in reference voltage generating circuit 4B. In reference voltage generating circuit 4C, the respective gates of transistors TrC-1 to TrC-5 are connected to node Z1. Threshold Vtp is input to these gates. This reduces the temperature dependency of channel resistance Rc. Therefore, as shown in FIG. 22, the ratio of threshold Vtp with negative temperature dependency is higher to that of channel resistance Rc.

It is noted that the tuning steps are programmed using a fuse. A switch control circuit controlling switches with the fuse will be described with reference to FIGS. 23 and 24.

Switch control circuit 50 shown in FIG. 23 includes transistors T101 to T103, NAND circuit 11, a fuse 12, inverters 15 and 16, and a logic circuit 14. Transistor T101 is a PMOS transistor, and transistors T102 and T103 are NMOS transistors.

Transistor T101 and fuse 12 are connected in series between a power-supply voltage and a node FIN. Transistors T102 and T103 are connected between node FIN and a ground voltage. Inverter 15 inverts a signal at node FIN. The gate of transistor T102 receives a signal BIAS output from constant-current generating circuit 3, and the gate of transistor T103 receives an output of inverter 15. NAND circuit 11 receives two types of signals, i.e., a signal TSIGn and a tuning signal TUNE. Logic circuit 14, receiving an output of NAND circuit 11 and an output of inverter 16 inverting the output of inverter 15, outputs a control signal MODEn.

A switch SWn receiving an output of switch control circuit 50 is turned on/off in response to control signal MODEn.

A switch control circuit 60 shown in FIG. 24 includes an inverter 17, in addition to the configuration of switch control circuit 50. Inverter 17 inverts the output of logic circuit 14 and outputs a control signal /MODEn. Switch SWn receiving the output of switch control circuit 60 is turned on/off in response to control signal /MODEn.

Tuning signal TUNE is at level L in a normal operational state, and becomes at level H when a tuning mode is activated. Signal TSIGn is a signal for controlling on/off of switch SWn during the tuning mode.

Signal BIAS prevents node FIN from being in a floating state when the fuse is blown off.

Assuming here that the size of transistor T102 receiving signal BIAS at the gate thereof is the same as that of transistors TrN-1 and TrN-2, then current I as same as the one in reference voltage generating circuit 4A will flow due to a current mirror effect.

As described above, current I is a small current represented by I=ΔV/Rt, and thus node FIN is at level H before fuse 12 is blown off. By contrast, after fuse 12 is blown off, node FIN is driven to level L by signal BIAS, and the value will be latched.

In the normal operational state, where the tuning signal TUNE is L, switch control circuit 50 turns off switch SWn (control signal MODEn is L) if the fuse is not yet blown off. Control signal MODEn will have level H after the fuse is blown off, so that switch SWn is turned on.

In the normal operational state, where tuning signal TUNE is L, switch control circuit 60 turns on switch SWn (control signal /MODEn is H) if the fuse is not yet blown off.

Switch control circuit 50 is arranged for each of switching SWl to SW3 of reference voltage generating circuits 4A to 4C, and switch control circuit 60 is arranged for switch SW4 of reference voltage generating circuits 4A to 4C.

Switch control circuits arranged for switches SW1 to SW4 are denoted by switch control circuits 111 to 114. Switch control circuit 111 receives signals TUNE and TSIG1, and outputs a control signal MODE1. Switch control circuit 112 receives signals TUNE and TSIG2, and outputs control signal MODE2. Switch control circuit 113 receives signals TUNE and TSIG3, and outputs a control signal MODE3. Switch control circuit 114 receives signals TUNE and TSIG4, and outputs a control signal MODE4.

First, such switch control circuits are used to change the voltage levels of control signals by two types of signals, i.e., TSIGn and TUNE, before the fuse is blown off. This can simulate a state where fuse 12 is virtually blown off, to monitor an internal power supply. Based on the monitored result, a dedicated test device is used to blow off the fuse by a laser.

If such a fuse element system is used, the fuse is protected by a guard ring or the like such that polysilicon or the like sputtered by the laser will not adversely affect the other circuits.

Thus, the area of a redundancy circuit programmed by the fuse element system is enlarged. As a design rule is progressed, the rate of the fuse occupied in the chip area has become a problem. A tuning information transfer system transferring tuning information has been developed to solve this problem.

In the tuning information transfer system, as described in Japanese Patent Laid Open No. 11-194838, voltage tuning information is transferred to a chip during a certain period after the power is turned on for a device.

It depends on a specification which of the fuse element system and the tuning information transfer system is used.

In a conventional circuit configuration, a temperature dependency of the reference voltage Vref level may significantly vary when a process variation is caused. Also, when a transition occurs from an initial small-lot production phase to a mass production phase, or when a mass production factory is changed, a constant process parameter may vary. In such a case, a reference voltage generating circuit may possibly show a constant large temperature dependency, and thus a circuit will have to be replaced. However, it is difficult to determine, at a designing stage, which type of the reference voltage generating circuit is optimal.

SUMMARY OF THE INVENTION

Therefore, the present invention provides a semiconductor integrated circuit device enabling generation of an optimal reference voltage without replacement of a circuit.

A semiconductor integrated circuit device according to the present invention includes a reference voltage generating circuit configured to be switched to any one of a plurality of circuit configurations having different properties, and generating a reference voltage using any one of the plurality of circuit configurations, and a control circuit for controlling switching of the plurality of circuit configurations.

Preferably, the plurality of circuit configurations include first and second circuit configurations different from each other, or first, second and third circuit configurations different from one another.

Particularly, the control circuit generates a control signal for the switching in response to a test mode, and the reference voltage generating circuit is switched, for tuning, to any one of the plurality of circuit configurations based on the control signal.

Particularly, the control circuit generates a control signal for the switching based on a combination of two exclusive test modes, and the reference voltage generating circuit is switched, for tuning, to any of a plurality of circuit configurations based on the control signal.

Particularly, the control circuit includes a fuse, and generates a control signal for the switching by blowing off the fuse.

Particularly, the control circuit includes a latch circuit, and generates a control signal for the switching based on tuning information held in the latch circuit.

Particularly, the reference voltage includes a first reference voltage and a second reference voltage different from the first reference voltage. The semiconductor integrated circuit device according to the present invention further includes a first buffer receiving the first reference voltage and a second buffer receiving the second reference voltage.

Therefore, according to the semiconductor integrated circuit device, the reference voltage generating circuit can perform an optimal circuit configuration among a plurality of possible circuit configurations, to generate a reference voltage. Thus, even an emergent process variation can be dealt with. A tuning can be performed with an optimal reference voltage generating circuit adapted to a process condition, without a troublesome replacement of circuits.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 illustrates an operation of a semiconductor integrated circuit device 2000 according to the second embodiment.

FIG. 12 illustrates an operation of a semiconductor integrated circuit device according to the fourth embodiment.

FIG. 17 shows on/off states of switches SW1 to SW4 for each tuning step.

DESCRIPTION OF THE PREFERRED EMBODIMENTS

Figure 1:
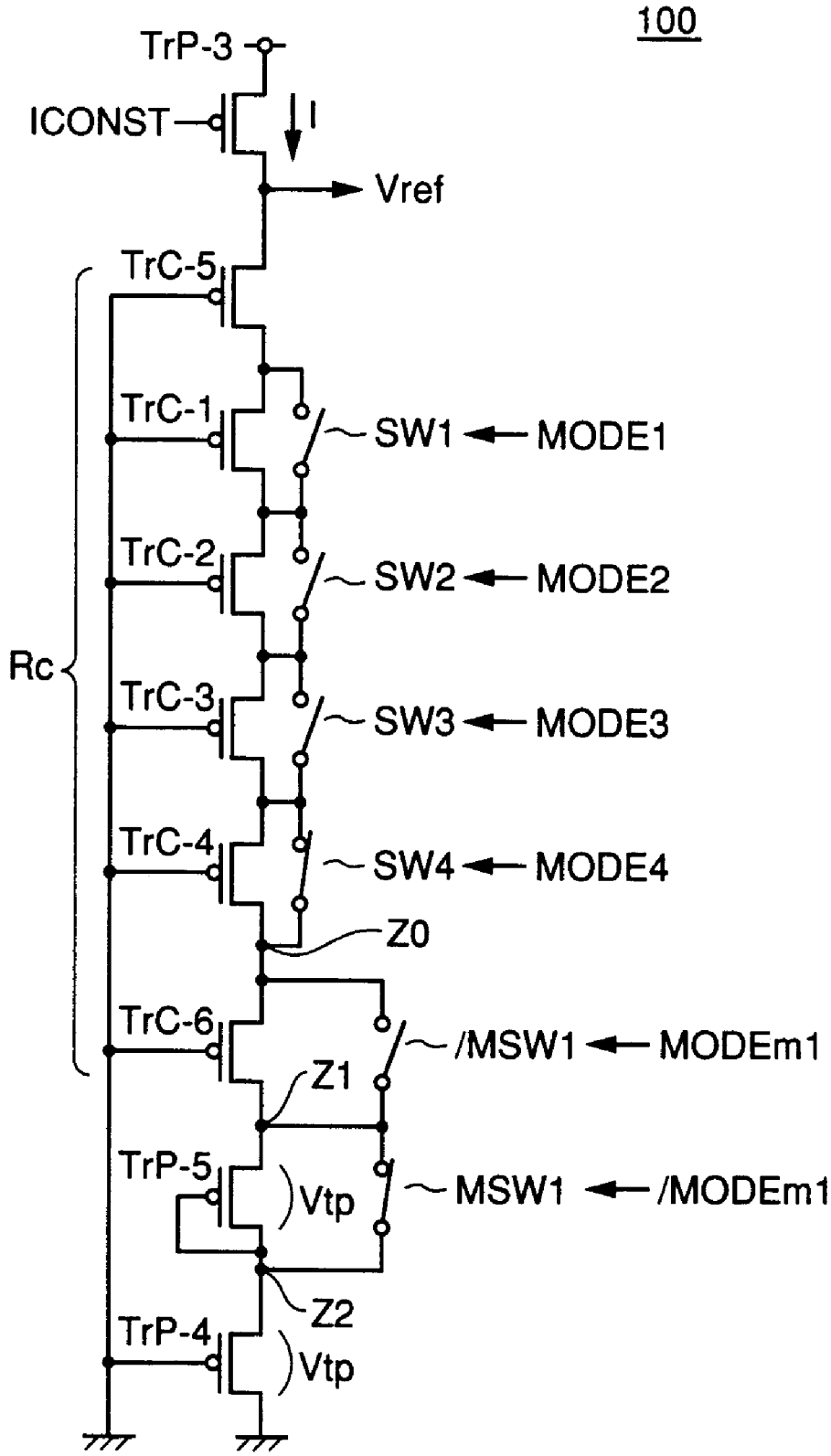
FIG. 1 is a circuit diagram showing a configuration of a reference voltage generating circuit 100 according to the first embodiment.

A semiconductor integrated circuit device according to embodiments of the present invention will be described below with reference to the drawings. In the drawings, the same or the corresponding portions are denoted by the same reference characters, and the descriptions thereof will not be repeated.

First Embodiment

A semiconductor integrated circuit device 1000 according to the first embodiment is described with reference to FIGS. 1 to 3. Semiconductor integrated circuit device 1000 according to the first embodiment includes a reference voltage generating circuit 100. Reference voltage generating circuit 100 includes transistors TrC-1 to TrC-6, TrP-3 to TrP-5, and switches MWS1, /MWS1 and SW1 to SW4. Transistors TrC-1 to TrC-6 and TrP-3 to TrP-5 are PMOS transistors.

Transistor TrP-3 is connected between a power-supply voltage and a node Vref outputting a reference voltage Vref, and receives a signal ICONST at the gate thereof. Transistors TrC-5, TrC-1, TrC-2, TrC-3 and TrC-4 are connected in series between node Vref and a node ZO, and transistor TrC-6 is connected between node Z0 and a node Z1. The respective gates of transistors TrC-1 to TrC-6 receives a ground voltage.

Transistor TrP-5 is connected between node Z1 and a node Z2, the gate thereof being connected to node Z2. Transistors TrP-4 is connected between node Z2 and the ground voltage, the gate receiving the ground voltage.

Transistor TrP-3 which receives signal ICONST at the gate allows a constant current I to flow therein. Transistors TrC-1 to TrC-6 are channel resistance elements. The resistance value of a channel resistance element is denoted by Rc. Transistors TrP-4 and TrP-5 are respectively diode-connected, each threshold thereof being denoted by Vtp.

Switches SW1 to SW4 are switches for performing tunings in 16 different ways. A switch SWi (i=1 to 4) is turned on/off in response to a control signal MODEi. When switch SWi is turned on, the source and the drain of a transistor TrC-i are connected.

A switch MSW1 is a switch for switching circuit configurations of (1Vtp+R) type (reference voltage generating circuit 4A) and (2Vtp+R) type (reference voltage generating circuit 4B). Switch MSW1 is turned on/off in response to a control signal /MODEm1. When switch MSW1 is turned on, the source and the drain of transistor TrP-5 are connected.

Switch /MSW1 is a switch having an on/off relation opposite to that of switch MSW1. Switch/MSW1 is turned on/off in response to a control signal MODEm1 which is an inverse of control signal /MODEm1. When switch /MSW1 is turned on, the source and the drain of transistor TrP-6 are connected. Transistor TrC-6 adjusts channel resistance Rc.

Figure 2:
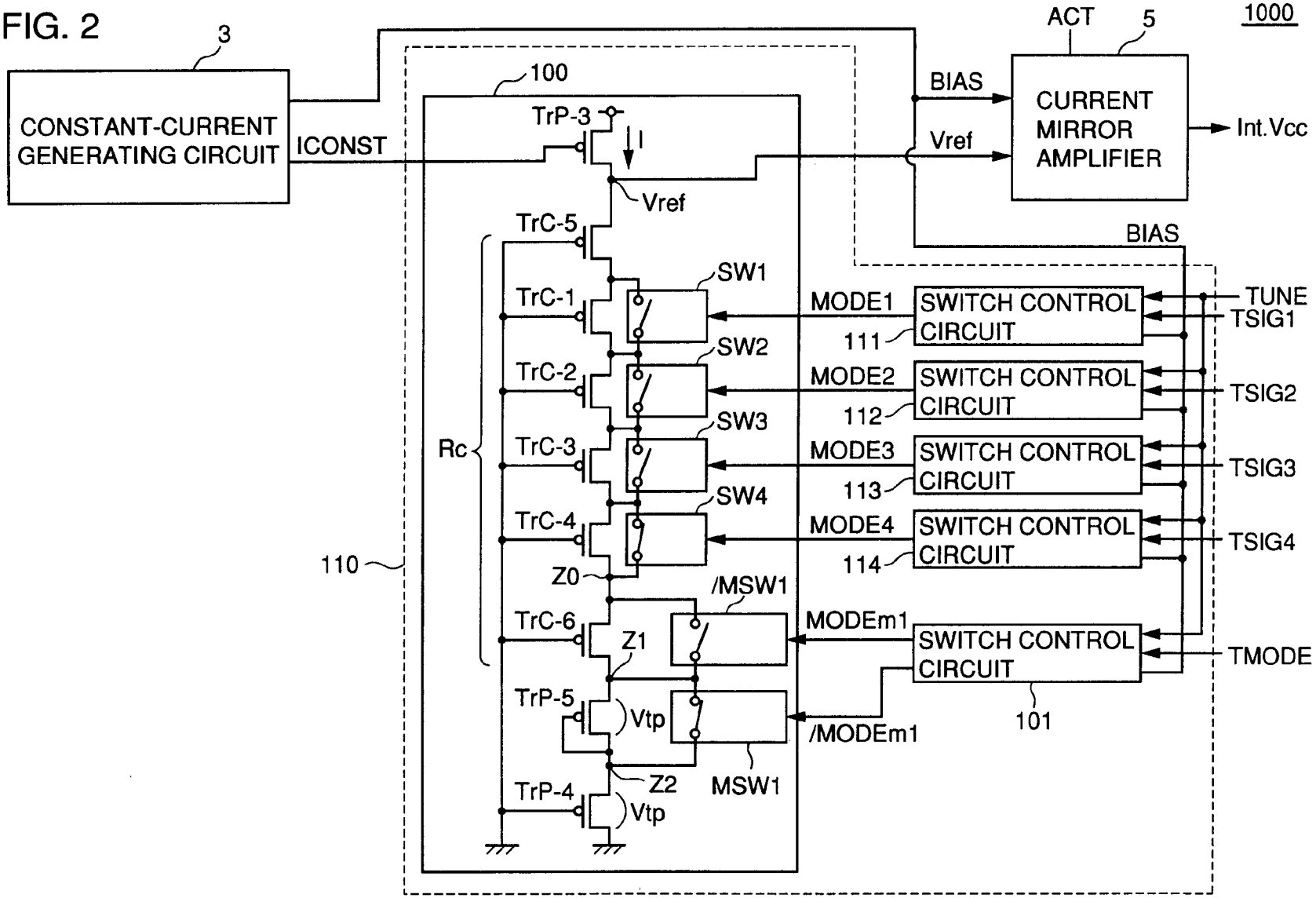
FIG. 2 is a schematic diagram showing a configuration of a semiconductor integrated circuit device 1000 according to the first embodiment.

Referring to FIG. 2, control signals MODE1 to MODE4 are generated by switch control circuits 111 to 114, and control signals MODEm1 and /MODEm1 are generated by a switch control circuit 101. Reference voltage generating circuit 100 and switch control circuits are all together referred to as a reference voltage generating unit 110.

Figure 23:
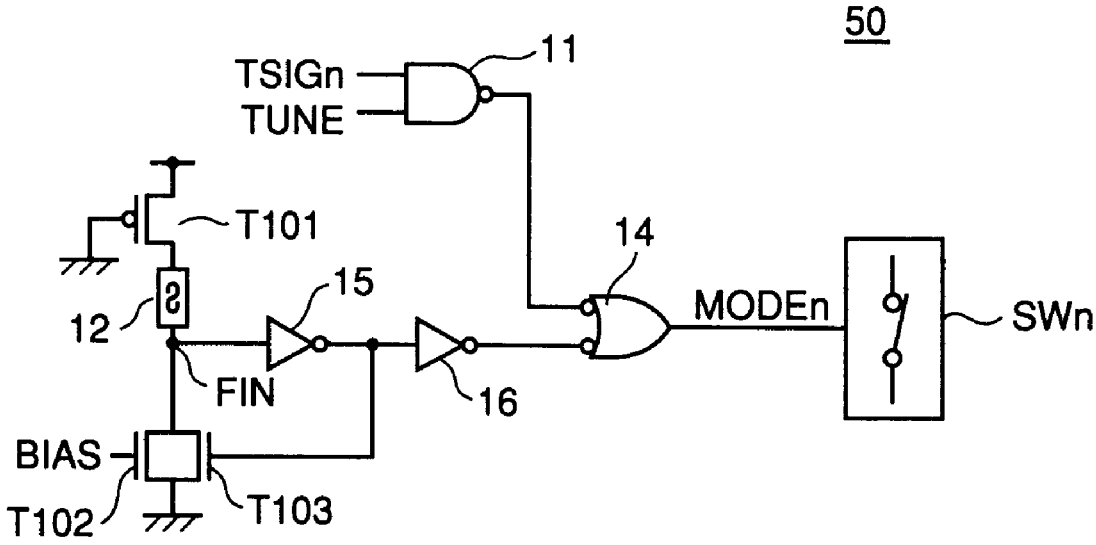
FIG. 23 PRIOR ART
FIG. 23 is a circuit diagram showing a configuration of a conventional switch control circuit 50.
Figure 24:
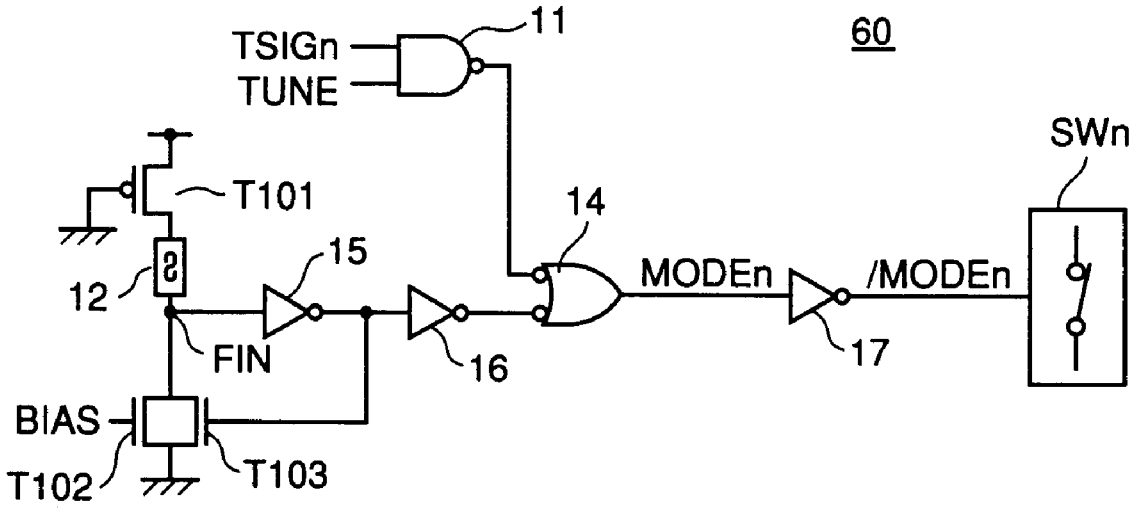
FIG. 24 PRIOR ART
FIG. 24 is a circuit diagram showing a configuration of a conventional switch control circuit 60.

As described above, switch control circuits 111 to 113 have the same circuit configurations as that of circuit 50 shown in FIG. 23, and switch control circuit 114 has the same circuit configurations as that of circuit 60 shown in FIG. 24. Switch control circuit 111 receives signals TUNE and TSIG1, and outputs a control signal MODE1. Switch control circuit 112 receives signals TUNE and TSIG2, and outputs a control signal MODE2. Switch control circuit 113 receives signals TUNE and TSIG3, and outputs a control signal MODE3. Switch control circuit 114 receives signals TUNE and TSIG4, and outputs a control signal MODE4. In a default state, switches SW1 to SW3 are off and switch SW4 is on.

Figure 3:
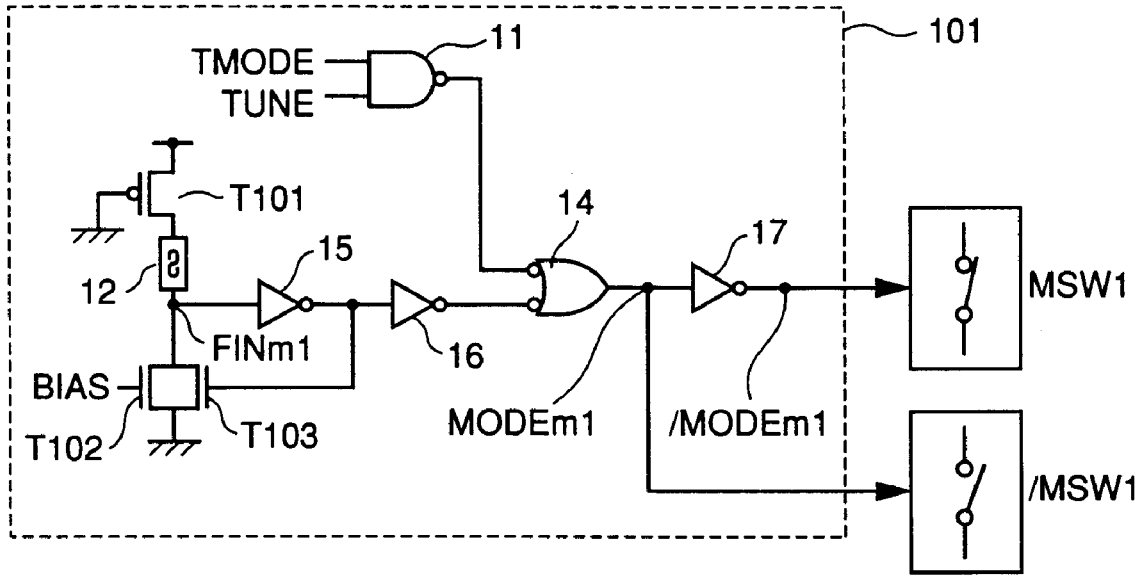
FIG. 3 is a circuit diagram showing a configuration of a switch control circuit 101 according to the first embodiment.

Referring to FIG. 3, switch control circuit 101 includes transistors T101 to T103, an NAND circuit 11, a fuse 12, inverters 15 to 17, and a logic circuit 14.

NAND circuit 11 receives a test mode signal TMODE and a tuning signal TUNE. Transistor T101 and fuse 12 are connected in series between a power-supply voltage and a node FINm1. Transistor T101 receives a ground voltage at the gate thereof. Inverter 15 inverts a signal FINm1 of node FINm1.

Transistors T102 and T103 are connected in parallel between node FINm1 and a ground voltage. The gate of transistors T102 receives a signal BIAS, and the gate of transistors T103 receives an output of inverter 15.

Inverter 16 inverts the output of inverter 15. Logic circuit 14 receives outputs of NAND circuit 11 and inverter 16, and outputs a control signal MODEm1 to node MODEm1. Inverter 17 inverts control signal MODEm1, and outputs a control signal /MODEm1.

Referring to FIG. 2, semiconductor integrated circuit device 1000 further includes a constant-current generating circuit 3 and a current mirror amplifier 5. Signal BIAS output from constant-current generating circuit 3 is supplied to switch control circuits 111 to 114 and 101, and to current mirror amplifier 5. A signal ICONST output from constant-current generating circuit 3 is supplied to reference voltage generating circuit 100. Current mirror amplifier 5 receives reference voltage Vref and generates a voltage int.Vcc.

The relations between the circuit configuration of reference voltage generating circuit 100 according to the first embodiment and signals will now be described.

When tuning signal TUNE is at level L, control signal MODEm1 is at level L if the fuse is not yet blown off. Switch MSW1 is on, whereas switch /MSW1 is off. Thus, reference voltage generating circuit 100 has a circuit configuration of (1Vtp+R) type. After the fuse is blown off, switch MSW1 is turned off, whereas switch /MSW1 is turned on. Thus, reference voltage generating circuit 100 is switched to a circuit configuration of (2Vtp+R) type.

A circuit configuration can also be switched in test modes including a tuning mode.

Figure 4:
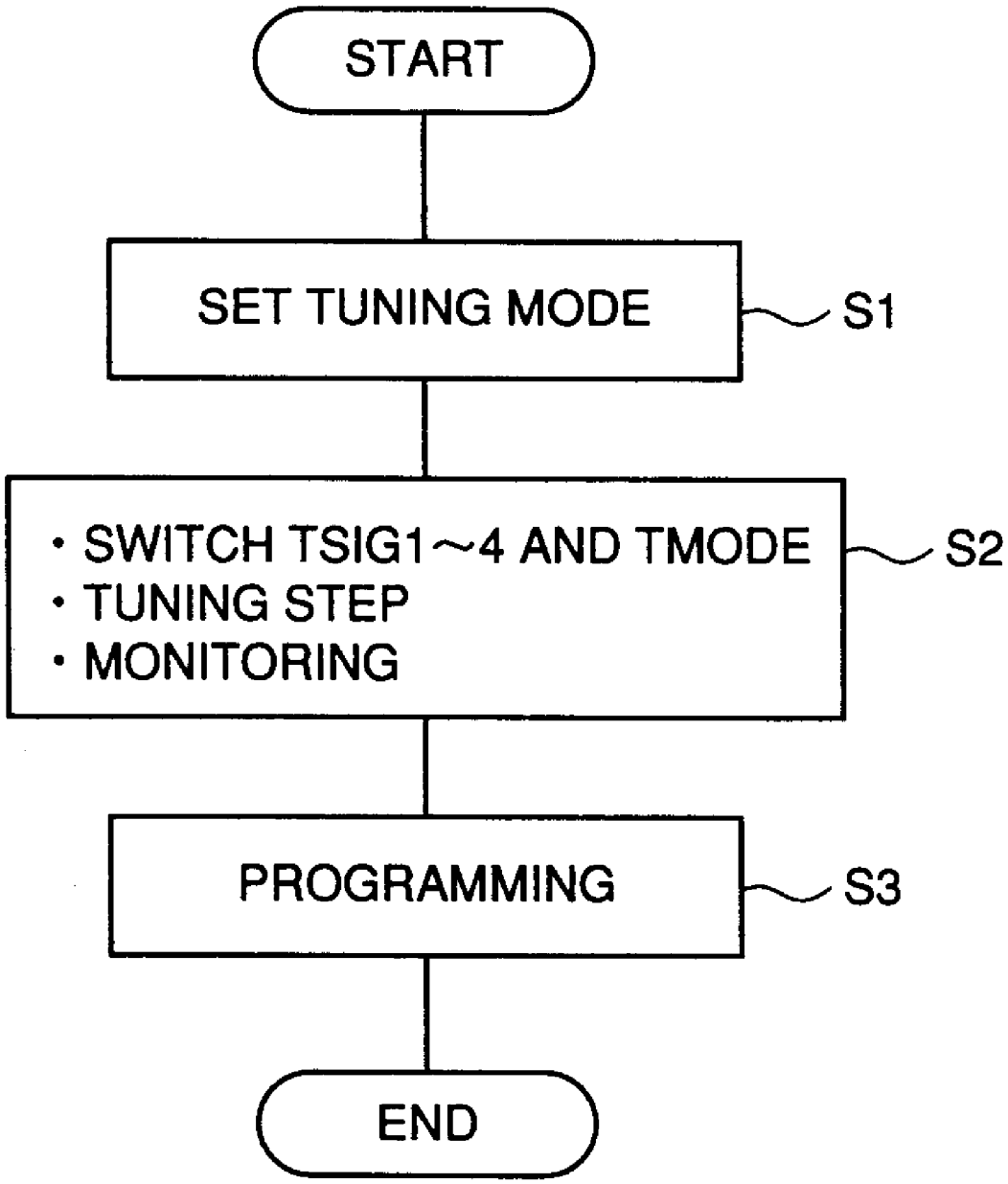
FIG. 4 is a flow chart illustrating an operation of a semiconductor integrated circuit device 1000 according to the first embodiment.

For example, as shown in FIG. 4, tuning signal TUNE is set to level H (step S1). The device enters in the tuning mode.

Thereafter, signals TSIG1 to TSIG4 and a test mode signal TMODE are switched (step S2). If test mode signal TMODE is set to level L, the tuning mode will be (1Vtp+R) type. Switches SW1 to SW4 are switched, and an internal power-supply is monitored.

If test mode signal TMODE is at level H, the circuit enters in the tuning mode of (2Vtp+R) type. Switches SW1 to SW4 are switched, and an internal power-supply is monitored.

Based on the monitored result, programming, i.e., blow-off of the fuse, is performed.

If the process varies, channel resistance Rc and threshold Vtp will be off-balanced. Un-tuned state is set to a middle stage of the tuning steps, e.g., tuning step 9, such that the values of channel resistance Rc and threshold Vtp can appropriately be adjusted even if they are off toward either higher or lower side.

If the process variation of channel resistance Rc and threshold Vtp is small, a circuit configuration of (2Vtp+R) type with low temperature dependency at the middle stage of the tuning steps will desirably be used for tuning.

By contrast, if a component with negative temperature dependency is increased, e.g., when threshold Vtp component is increased, a circuit configuration of (1Vtp+R) type having positive temperature dependency will desirably be used for tuning.

Thus, according to the first embodiment, an optimal circuit configuration, which is difficult to be determined at a designing stage, can be used also by switching the fuse. Therefore, even an emergent process variation can be dealt with.

Further, the state where the fuse is virtually blown off can be simulated. Therefore, virtual tuning can be performed for two types of circuits, i.e., (1Vtp+R) type and (2Vtp+R) type.

Thus, the trouble of circuit replacement and so forth can be avoided and tuning can be performed by an optimal reference voltage generating circuit adapted to a process condition.

Second Embodiment

In the second embodiment, switching of the tuning mode is controlled by combining a tuning mode and a test mode exclusive of the tuning mode.

Generally, a memory device includes a plurality of test modes other than the tuning mode. Some of the test modes are exclusive of the tuning mode.

For example, there is a test mode for stopping generation of the internal power-supply voltage (hereinafter referred to as "stop mode"). If generation of the internal power-supply voltage stops during tuning of the internal power-supply voltage, tuning cannot be performed. Thus, in a conventional semiconductor integrated circuit device, the tuning mode and the stop mode are never performed simultaneously, but rather controlled to be exclusive of each other.

In the second embodiment, the tuning mode can be controlled by combining exclusive test mode signals related to the internal power-supply generation.

Figure 5:
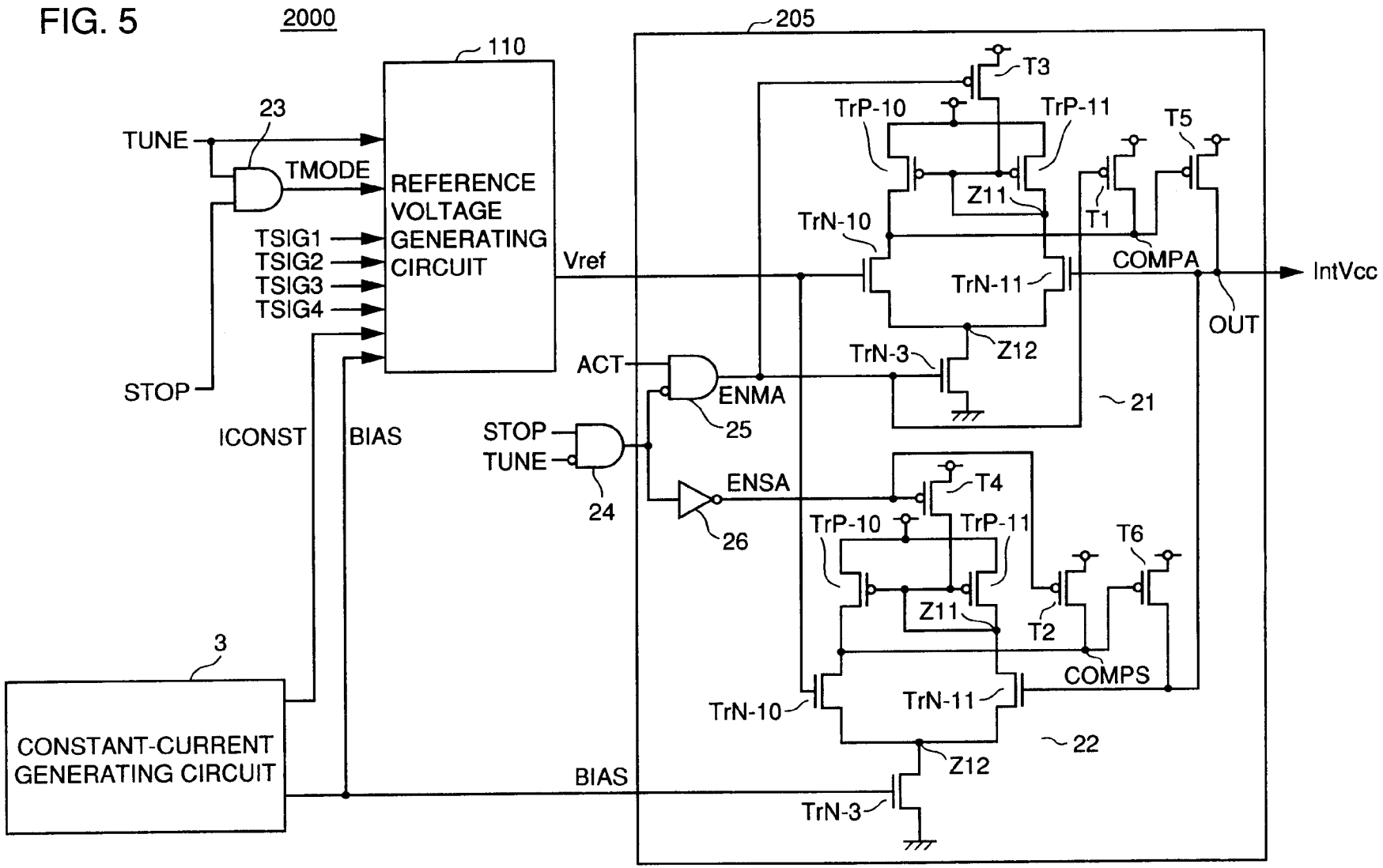
FIG. 5 is a schematic diagram showing an entire configuration of a semiconductor integrated circuit device 2000 according to the second embodiment.

An entire configuration of a semiconductor integrated circuit device 2000 according to the second embodiment is described with reference to FIG. 5. Semiconductor integrated circuit device 2000 includes a reference voltage generating unit 110, a constant-current generating circuit 3, an AND circuit 23, a logic circuit 24 and a current mirror amplifier 205.

AND circuit 23 receives tuning signal TUNE and stop mode signal STOP at the input thereof, and outputs a test mode signal TMODE. Logic circuit 24 receives stop mode signal STOP and tuning signal TUNE, and performs a logic operation.

Reference voltage generating unit 110 receives test mode signal TMODE output from AND circuit 23. If tuning signal TUNE and stop mode signal STOP are at level H, test mode signal TMODE will also be at level H, otherwise it will be at level L.

Current mirror amplifier 205 includes a main amplifier 21, a sub amplifier 22, a logic circuit 25 and an inverter 26.

Logic circuit 25 receives activation signal ACT and an output of logic circuit 24, and outputs a main enable signal ENMA. Inverter 26 inverts the output of logic circuit 24 and outputs a sub enable signal ENSA.

The relations among signals STOP, TUNE and ENSA (ENMA) will be described later.

Main amplifier 21 is now described. Main amplifier 21 includes a PMOS transistor T3 in addition to the configuration of main amplifier 1. In main amplifier 21, the gate of transistor TrN-10 receives reference voltage Vref output from reference voltage generating circuit 100, and each gate of transistors TrN-3 and T1 receives an enable signal ENMA. Transistor T3 is connected between a node Z11 and a power-supply voltage, and receives enable signal ENMA at the gate thereof.

Sub amplifier 22 is now described. Sub amplifier 22 includes a PMOS transistor T6 in addition to the configuration of sub amplifier 2. In sub amplifier 22, the gate of transistor TrN-10 receives reference voltage Vref output form reference voltage generating circuit 100, the gate of transistor TrN-3 receives signal BIAS output from constant-current generating circuit 3, and the gate of transistor T2 receives enable signal ENSA. Transistor T4 is connected between node Z11 and the power-supply voltage, and receives enable signal ENSA at the gate.

Transistors T3 and T4 prevents through current from flowing in current mirror amplifier 205 in an inactivated state.

Stop mode signal STOP is at level L in the normal operational state, and will be at level H when the stop mode is set.

The relations shown in FIG. 6 are effected in the configuration described above. When stop mode signal STOP and tuning signal TUNE are at level H, enable signal ENSA (ENMA) will be at level H and test mode signal TMODE will also be at level H. Reference voltage generating circuit 100 will have a circuit configuration of (2Vtp+R) type.

If stop mode signal STOP is at level L whereas tuning signal TUNE is at level H, enable signal ENSA (ENMA) is at level H, and test mode signal TMOD is at level L. Reference voltage generating circuit 100 will have a circuit configuration of (1Vtp+R) type.

If stop mode signal STOP is at level H whereas tuning signal TUNE is at level L, enable signal ENSA (ENMA) will be level L. Because the enable signal is at level L, nodes COMPA and COMPS are brought to level H by transistors T1 and T2. Therefore, the power supplied to a node OUT (int. Vcc) stops and thus node OUT will be in a floating state.

When stop mode signal STOP is at level L and tuning signal TUNE is at level L, enable signal ENSA (ENMA) will be at level H, which is a normal operational mode.

For example, only the tuning mode is set (TUNE=H, STOP=L), the tuning mode will be of (1Vtp+R) type.

When the stop mode is set while the tuning mode is set (TUNE=H, STOP=H), the tuning mode will be of (2Vtp+R) type.

Thus, test mode signal TMODE is controlled by combining test mode signals that are conventionally exclusive of each other, whereby it is unnecessary to generate other signals to operate the tuning mode signal.

Therefore, according to the second embodiment, existing test modes can be used to switch the tuning mode, so that circuits for setting the test mode can be down-scaled.

Further, a test mode such as the stop mode, which is exclusive of the tuning mode and used in an internal power-supply generating circuit (the current mirror amplifier is shown in the drawings for example) may be used, so as to reduce the number of interconnections from the circuit for setting the test mode to the internal power-supply generating circuit.

Third Embodiment

Figure 7:
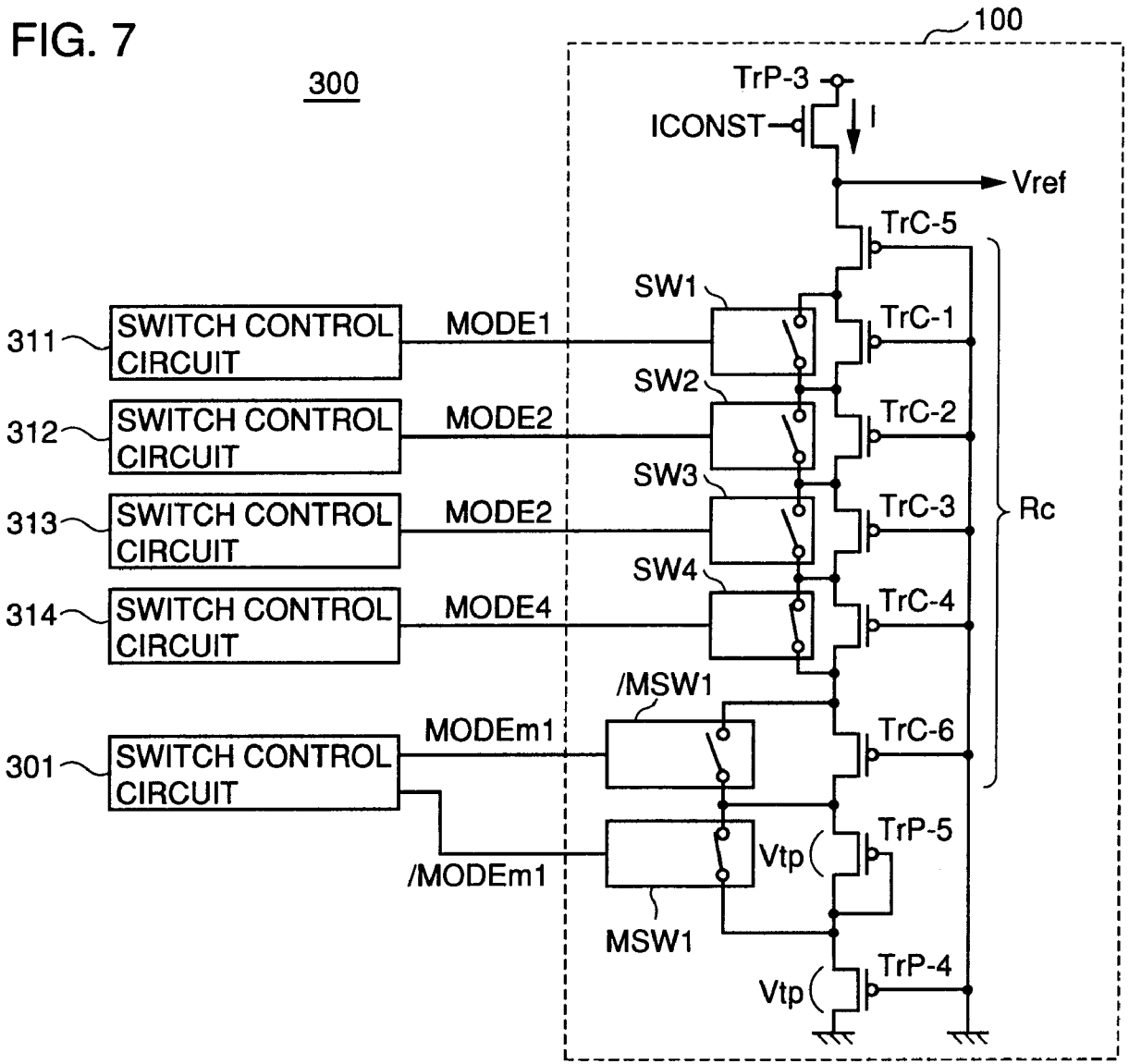
FIG. 7 shows a configuration of a reference voltage generating unit 300 according to the third embodiment.

Referring to FIG. 7, a reference voltage generating unit 300 according to the third embodiment includes a reference voltage generating circuit 100, and switch control circuits 301 and 311 to 314.

On/off of switch /MSW1 is controlled by control signal MODEm1 output from switch control circuit 301, and on/off of switch MSW1 is controlled by control signal /MODEm1.

Switch control circuits 311 to 314 output control signals MODE1 to 4. On/off of switch SWi (i=1 to 4) is controlled by control signal MODEi.

Figure 8:
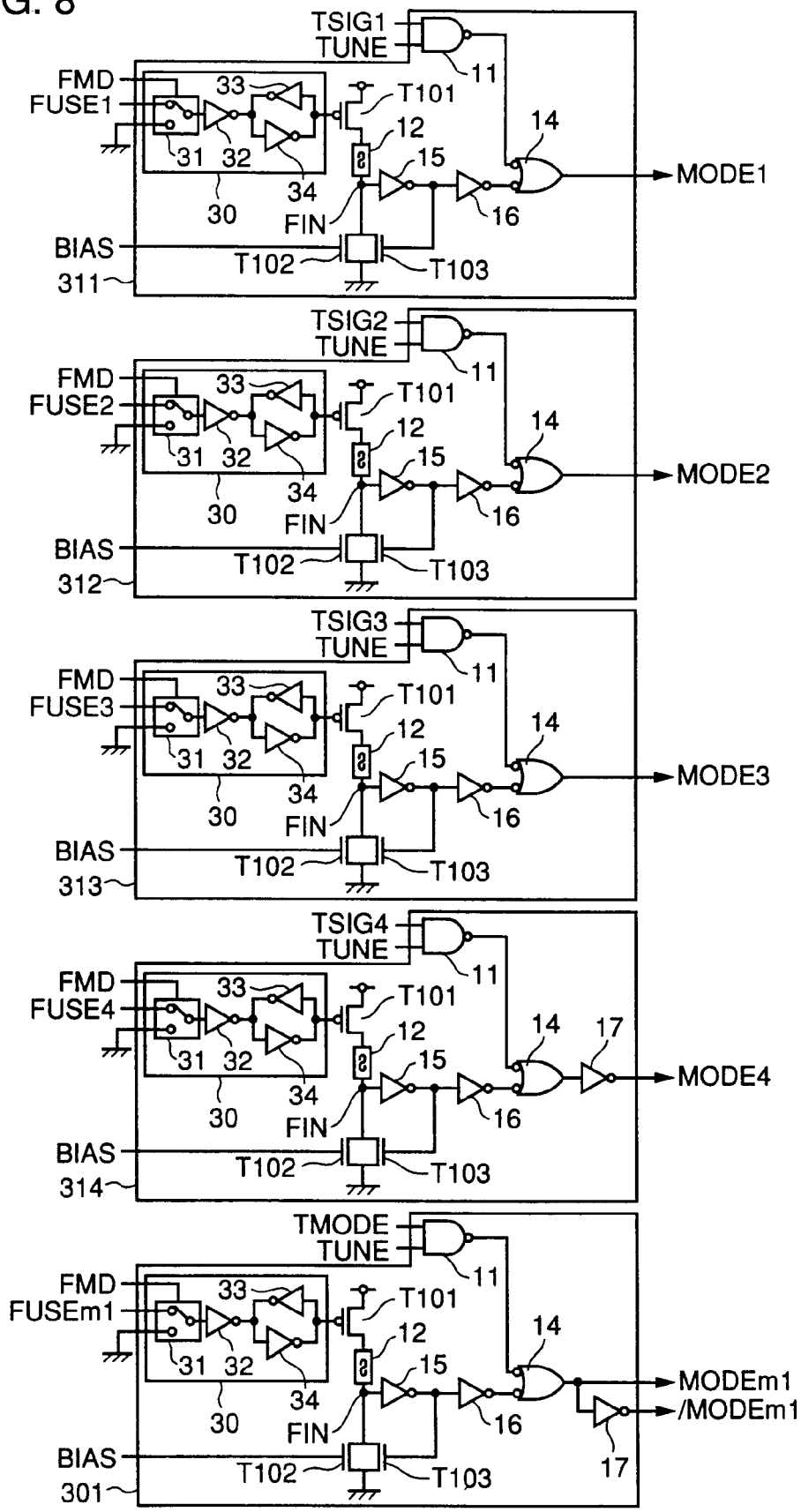
FIG. 8 is a circuit diagram showing a configuration of a switch control circuit according to the third embodiment.

Referring to FIG. 8, each of switch control circuits 311 to 314 and 301 includes a latch circuit 30, an NAND circuit 11, transistors T101 to T103, a fuse 12, a logic circuit 14 and inverters 15 and 16.

NAND circuit 11, transistors T101 to T103, fuse 12, logic circuit 14, and inverters 15 and 16 are connected in the same manner as that of switch control circuit 101.

Each of switch control circuits 314 and 301 further includes an inverter 17 inverting an output of logic circuit 14.

Logic circuits 14 of switch control circuits 311 to 313 output control signals MODE 1 to 3. Inverter 17 of switch control circuit 314 outputs a control signal MODE 4. Logic circuit 14 of switch control circuit 301 outputs a control signal MODEm1, and inverter 17 outputs a control signal /MODEm1.

NAND circuit 11 of a switch control circuit 31i (i=1 to 4) receives a signal TSIGi and a tuning signal TUNE. NAND circuit 11 of switch control circuit 301 receives a test mode signal TMODE and tuning signal TUNE.

The gate of transistor T101 receives an output of latch circuit 30. Latch circuit 30 includes a switch 31 and inverters 32 to 34.

Switch 31 of switch control circuit 31*i* (i=1 to 4) applies a tuning information signal FUSEi or a ground voltage to inverter 32 in response to a switching signal FMD. Switch 31 of switch control circuit 301 applies a tuning information signal FUSEm1 or the ground voltage to inverter 32 in response to a switching signal FMD.

Inverter 32 inverts an output of switch 31. Inverters 33 and 34 are connected in parallel between inverter 32 and the gate of transistor T101, and latches an output of inverter 32.

Japanese Patent Laid-Open No. 11-194838 describes a semiconductor integrated circuit device having a configuration in which power-supply tuning information is transferred during a certain period after the power is turned on. In the third embodiment, tuning information transfer system and fuse element system are switched by switching signal FMD. Tuning information is stored in latch circuit 30. This can determine logic of control signals MODEi and MODEm1 in the normal operational state (TUNE=L).

Figure 9:
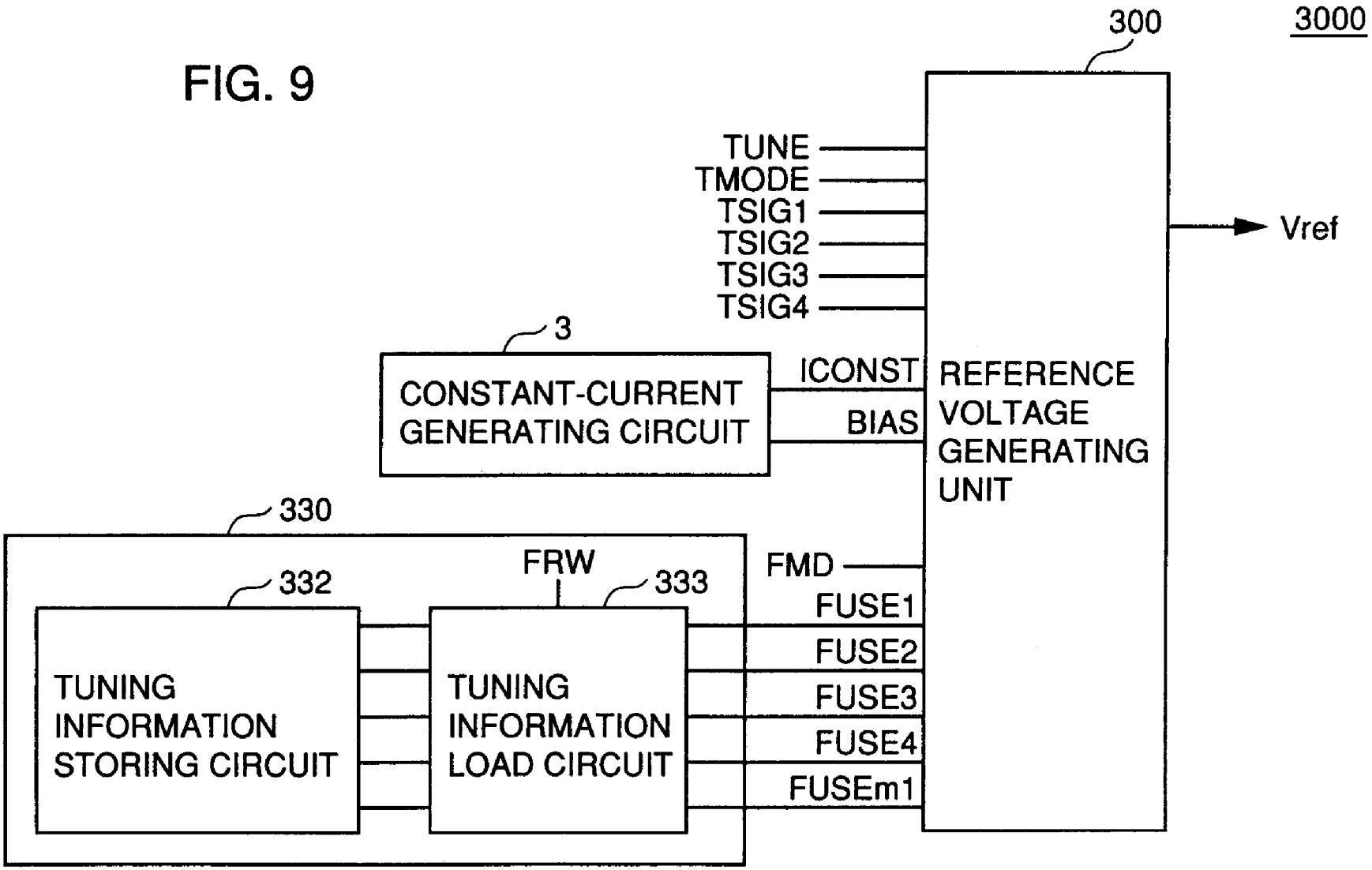
FIG. 9 is a block diagram schematically showing a configuration of a semiconductor integrated circuit device 3000 according to the third embodiment.

FIG. 9 shows a configuration of a main part of a semiconductor integrated circuit device 3000 according to the third embodiment. Referring to FIG. 9, semiconductor integrated circuit device 3000 includes a reference voltage generating unit 300, a control circuit 330 and a constant-current generating circuit 3.

Control circuit 330 is a circuit for realizing the tuning information transfer system, and includes a tuning information storing circuit 332 and a tuning information load circuit 333.

Tuning information storing circuit 332 stores states of switches SW1 to SW4, MSW1 and /MSW1 included in reference voltage generating unit 300.

After the power is turned on, a tuning information load signal FRW stays at level H for a certain period.

Tuning information load circuit 333 sets tuning information signals FUSE1 to FUSE4 and FUSEm1 based on the information in tuning information storing circuit 332, in response to tuning information load signal FRW.

When the tuning information transfer system is used, switching signal FMD is set to level M. Tuning information signals FUSE1 to FUSE4 and FUSEm1 are latched by latch circuit 30 included in each switch control circuit. Thereafter, tuning information load signal FRW comes to be at level L. Without blow-off of the fuse elements, the latched tuning information signals FUSE1 to FUSE4 and FUSEm1 determines the logic of control signals MODE1 to MODE4, MODEm and /MODEm1.

When the fuse element system is used, switching signal FMD is set to level L. An input of latch circuit 30 is fixed to a ground GND. The state of the fuse element determines the logic of control signals MODE1 to MODE4, MODEm1 and /MODEm1.

For example, when a memory device is mounted together with a logic device and so forth, the specification of a memory device core may be changed in accordance with the device mounted together. A fuse is blown off by a laser using a dedicated device. Thus, no interconnections can be provided on a layer above the fuse. Generally, a logic device has a multi-layer AL structure having more layers compared to a memory device. Therefore, when the logic device with multi-layer AL structure is mounted together with the memory device, the configuration described above is effected. Tuning information storing circuit 332 may be provided at an arbitrary location on a device.

As such, it depends on a specification of the device which of the fuse element system and the tuning information transfer system is appropriate. Thus, a configuration capable of switching of the fuse element system and the tuning information transfer system can realize a circuit adapted to the specification.

It is noted that no tuning information signals FUSE1 to FUSE4, FUSEm1 are required to be input into reference voltage generating unit 300 when the tuning information is stored by the fuse in reference voltage generating unit 300.

Thus, the semiconductor integrated circuit device according to the third embodiment can accommodate to each programming system without a change in a configuration of a switch control circuit, even if the programming system of tuning is changed.

For example, it is also possible that a switch control circuit of the fuse system may be arranged for each of switches SW1 to SW4, and thus a system in which the tuning information is partly transferred, not entirely, may be employed.

Fourth Embodiment

Figure 10:
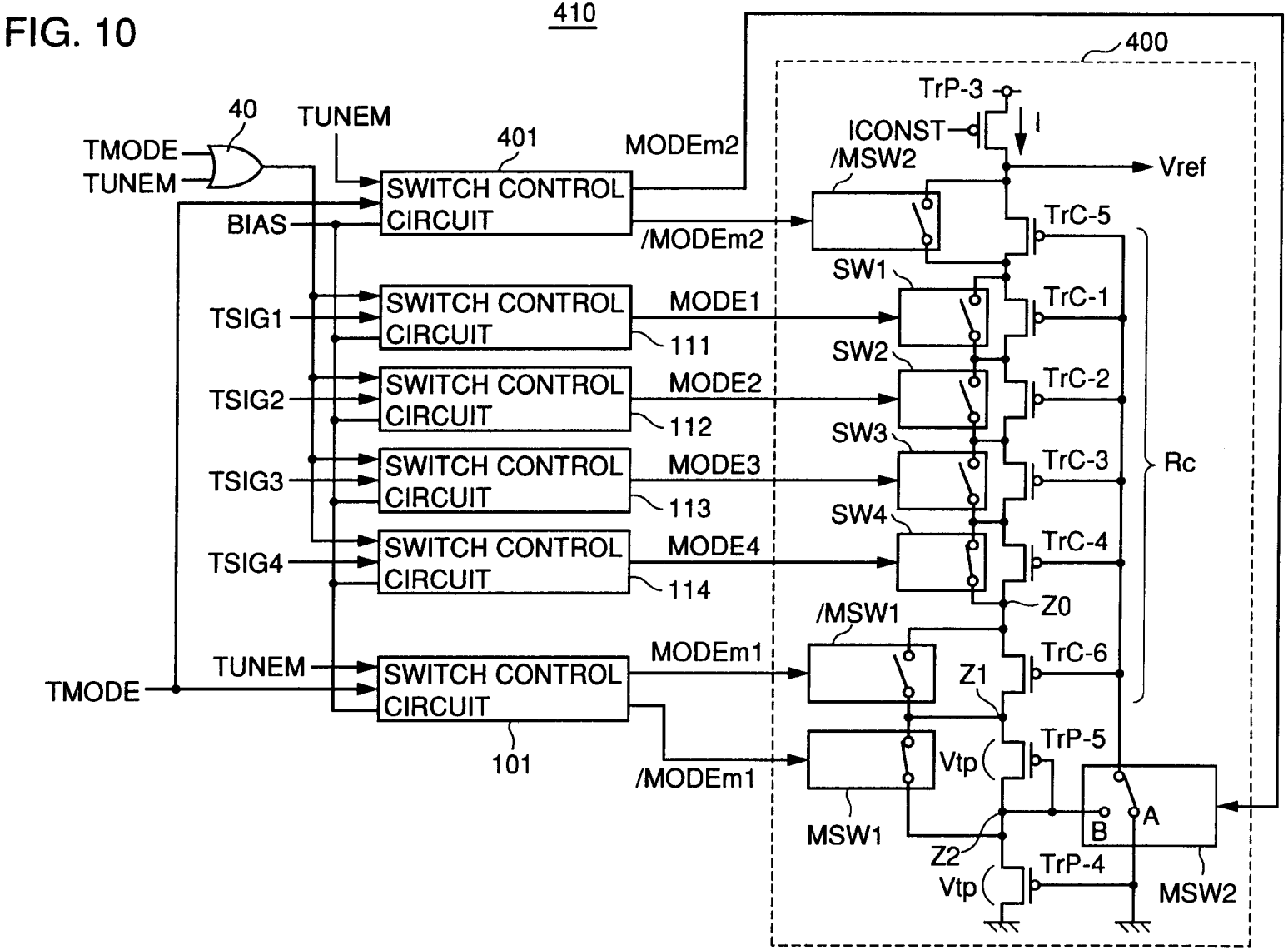
FIG. 10 shows a configuration of a reference voltage generating unit 410 according to the fourth embodiment.

A configuration of a reference voltage generating unit 410 according to the fourth embodiment is now described with reference to FIG. 10. Reference voltage generating unit 410 includes a reference voltage generating circuit 400 including transistors TrC-1 to TrC-6, TrP-3 to TrP-5, switches MWS1, /MWS1, SW1 to SW4 and MSW2, /MSW2, and also includes switch control circuits 111 to 114, 101 and 401.

The transistors in reference voltage generating circuit 400 are connected in the same manner as the ones in reference voltage generating circuit 100, except for the gates of transistors TrC-1 to TrC-6.

Switch MSW2 connects the gates of transistors TrC-1 to TrC-6 to a node A which receives a ground voltage, or to a node B which is connected to a connecting node Z2 of transistors TrP-5 and TrP-4. Switch /MSW2 connects the drain and the source of transistor TrC-5.

Switch MSW2 is controlled by a control signal MODEm2 output from switch control circuit 401, and switch /MSW2 is controlled by a control signal /MODEm2 output from switch control circuit 401.

Switches SW1 to SW4 are controlled by outputs of switch control circuits 111 to 114. Switches MSW1 and /MSW1 are controlled by an output of switch control circuit 101. In a default state, switches SW1 to SW3 are off, whereas switch SW4 is on.

Switch control circuits 111 to 114 are provided with an output of an OR circuit 40 receiving a test mode signal TMODE and a signal TUNEM instead of a tuning signal TUNE.

Figure 11:
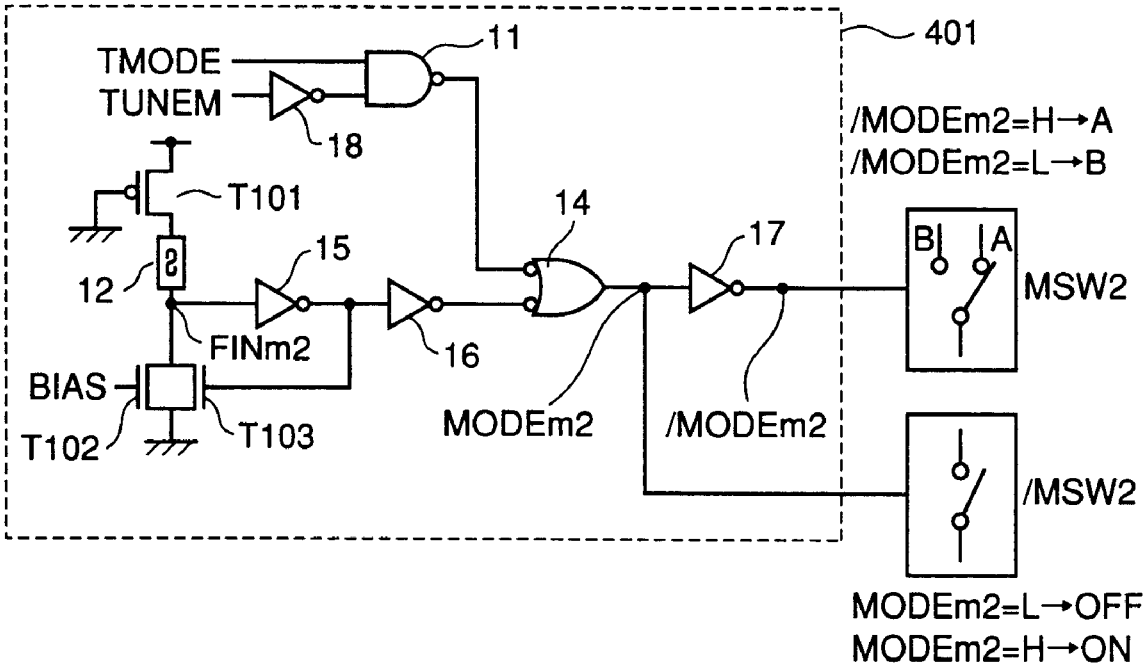
FIG. 11 is a circuit diagram showing a configuration of a switch control circuit according to the fourth embodiment.

Referring to FIG. 11, switch control circuit 401 includes transistors T101 to T103, an NAND circuit 11, a fuse 12, inverters 15 to 18, and a logic circuit 14.

NAND circuit 11 is provided with test mode signal TMODE and an output of inverter 18 which inverts signal TUNEM.

Transistors TI01 to T103, NAND circuit 11, fuse 12, inverters 15 to 17, and logic circuit 14 are connected in the same manner as that in switch control circuit 101. Logic circuit 14 and inverter 17 respectively output control signals MODEm2 and /MODEm2.

Switch MSW2 connects the gates of the transistors to a node A if control signal /MODEm2 is at level H, and to a node B if control signal /MODEm2 is at level L. By switch MSW2, the gates of the transistors will be at a level of threshold Vtp.

Switch /MSW2 is turned off if control signal MODEm2 is at level L, whereas is turned on if control signal MODEm2 is at level H. When switch /MSW2 is turned on, transistor TrC-5 is short-circuited and the value of channel resistance Rc is adjusted.

In the first embodiment, tuning signal TUNE was set to level H to enable switch control, and test mode signal TMODE was used to switch the circuit configurations of the reference voltage generating circuit.

By contrast, in the fourth embodiment, the circuit configuration of the reference voltage generating circuit is switched by total of 2 bit signals, i.e., tuning signal TUNEM and test mode signal TMODE, in conjunction with the setting of tuning signal TUNE to level H.

Signals TUNEM and TMODE are the signals set by switching a test mode as described in the first embodiment, or by combining test modes exclusive of each other, as described in the second embodiment.

An operation of the semiconductor integrated circuit device according to the fourth embodiment is now described with reference to FIG. 12. When signal TUNEM and test mode signal TMODE are at level L, the device is in a normal operational state and switches MSW1 and MSW2 are in a programmed state (default state).

Figure 18:
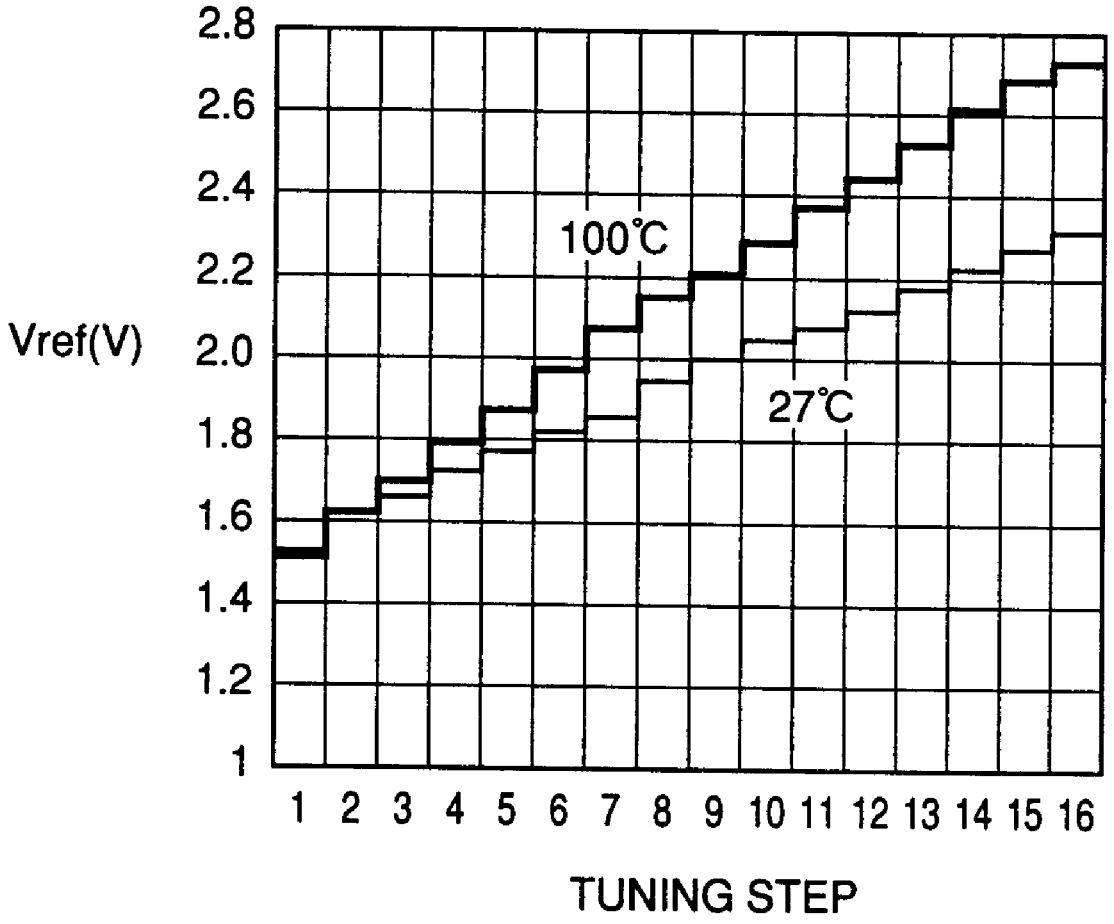
FIG. 18 PRIOR ART
FIG. 18 shows a temperature dependency of a conventional reference voltage generating circuit 4A.
Figure 19:
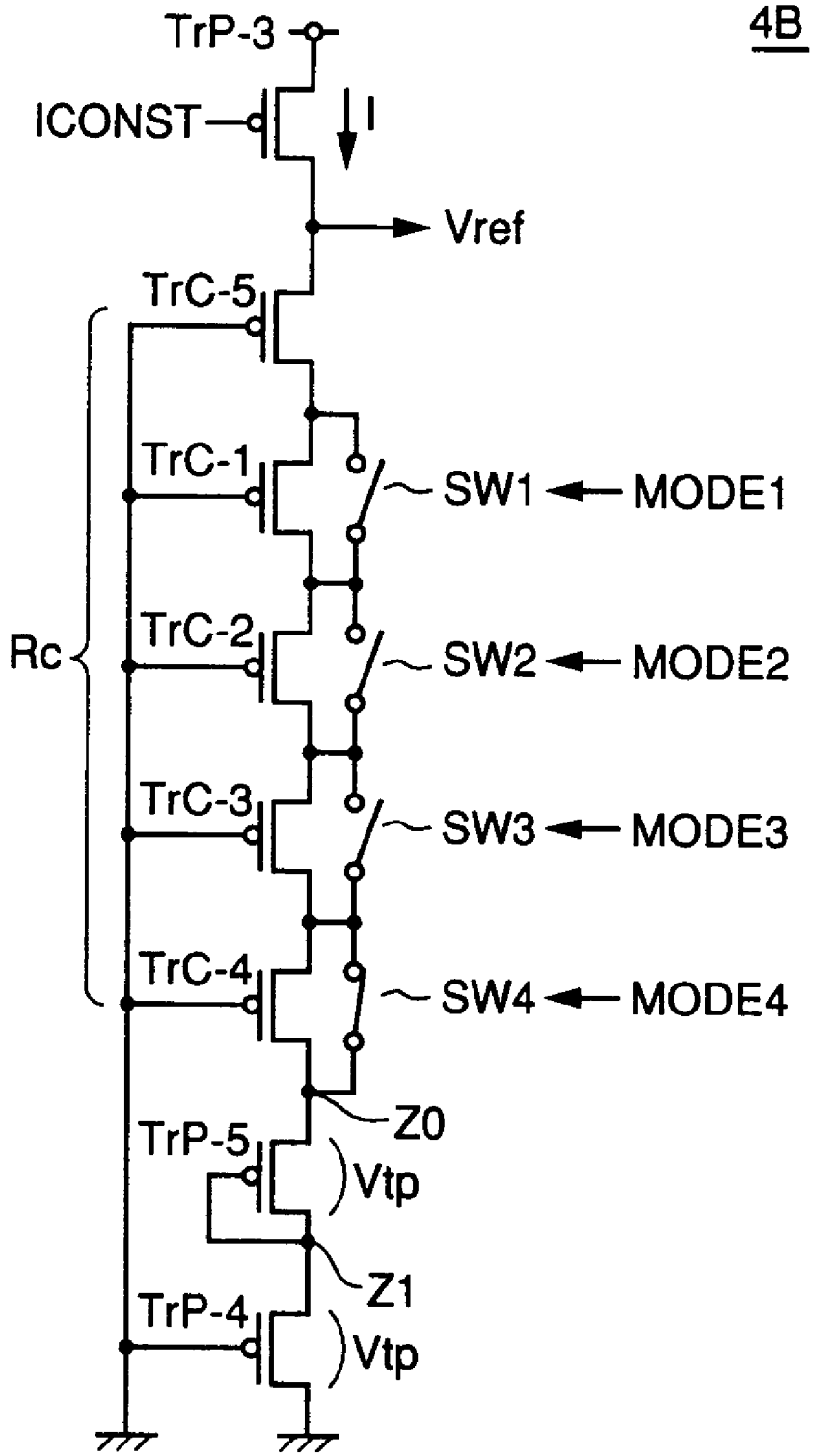
FIG. 19 PRIOR ART
FIG. 19 is a circuit diagram showing a configuration of a conventional reference voltage generating circuit 4B.

When signal TUNEM is at level H and test mode signal TMODE is at level L, switch MSW1 is turned on and switches /MSW1 and /MSW2 are turned off. Switch MSW2 connects the gate of the transistor to node A. In this case, reference voltage generating circuit 400 will have a circuit configuration of (1Vtp+R) type. Therefore, tuning can be performed with the circuit configuration of (1Vtp+R) type. The circuit configuration of (1Vtp+R) type has a positive temperature dependency as shown in FIG. 18.

Figure 20:
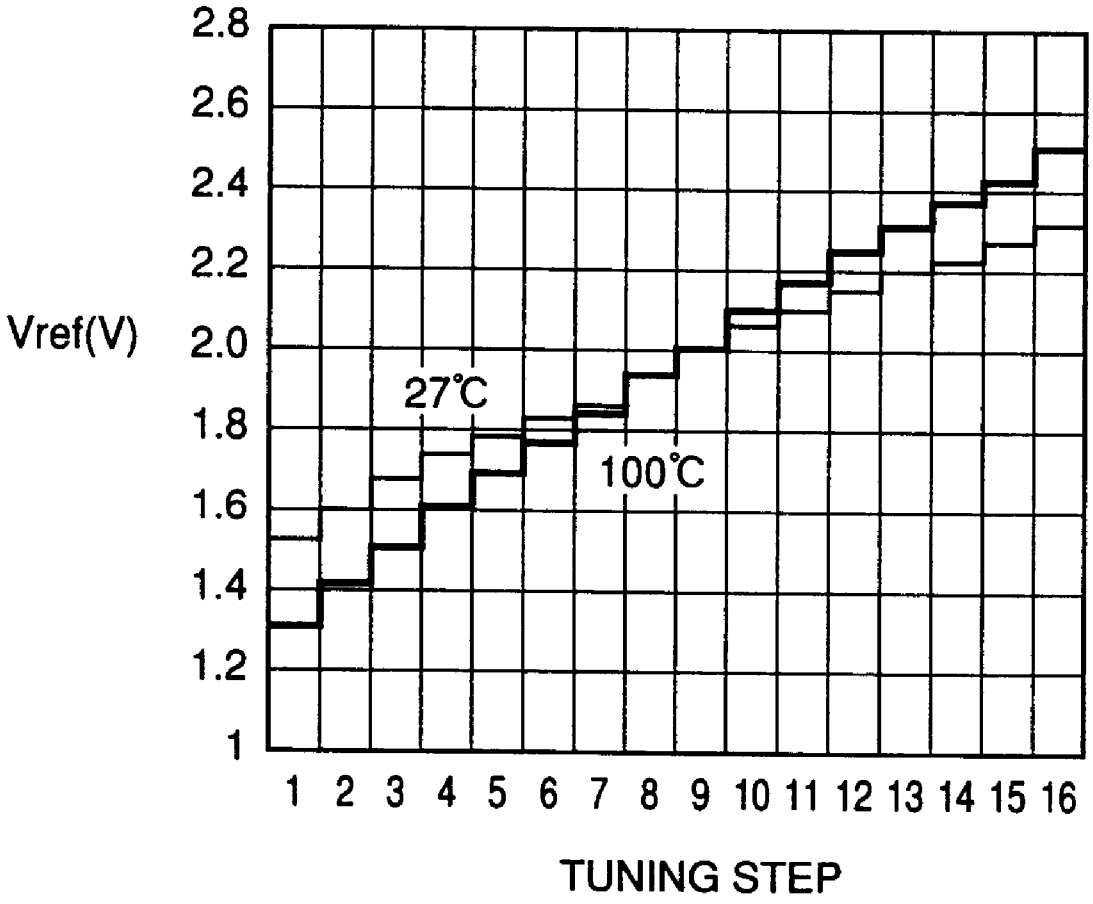
FIG. 20 PRIOR ART
FIG. 20 shows a temperature dependency of a conventional reference voltage generating circuit 4B.
Figure 21:
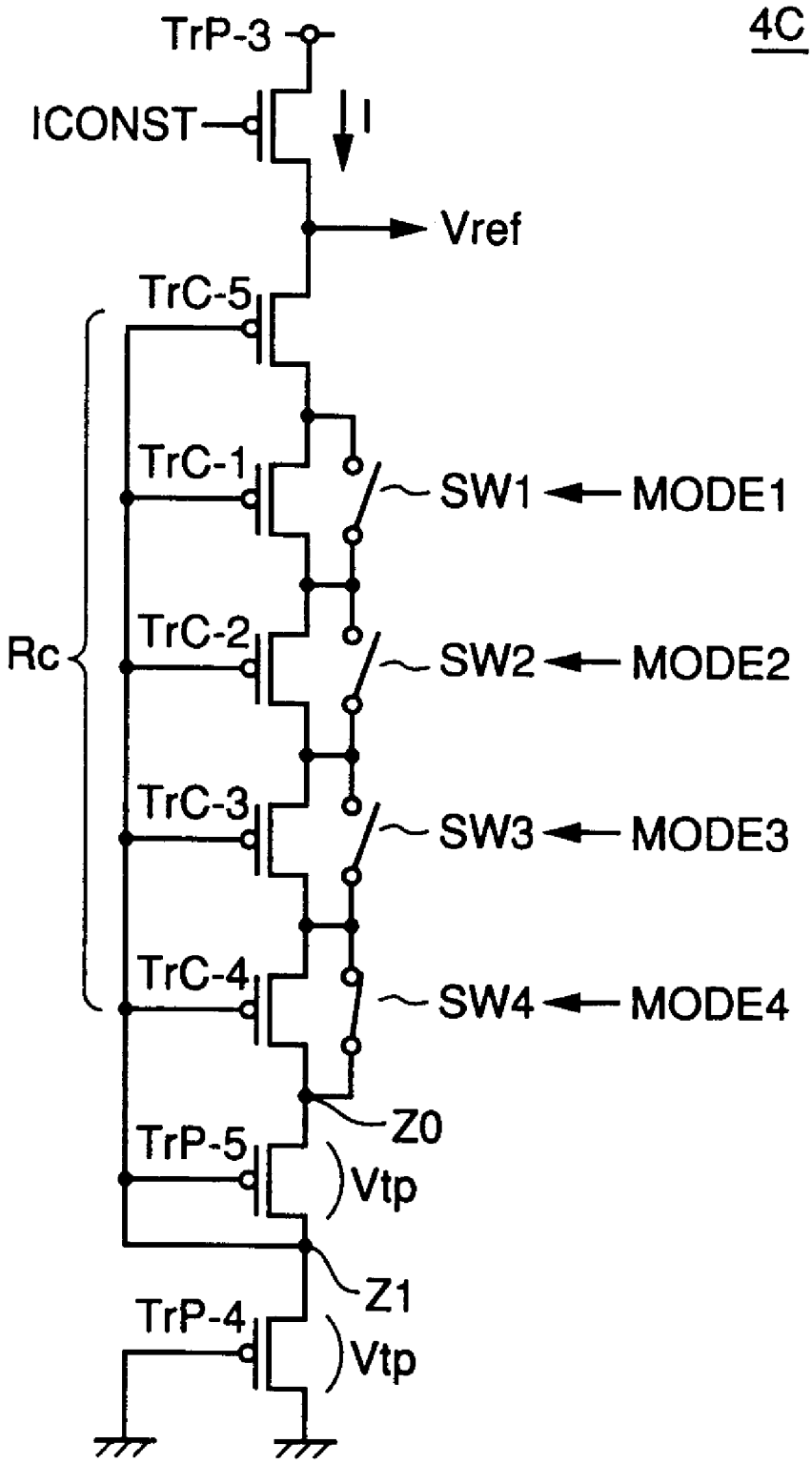
FIG. 21 PRIOR ART
FIG. 21 is a circuit diagram showing a configuration of a conventional reference voltage generating circuit 4C.

When signal TUNEM is at level H and test mode signal TMODE is at level H, switches MSW1 and /MSW2 are turned off and switch /MSW1 is turned on. Switch MSW2 connects the gates of the transistors to node A. In this case, reference voltage generating circuit 400 will have a circuit configuration of (2Vtp+R) type. Therefore, tuning can be performed with the circuit configuration of (2Vtp+R) type. Referring to FIG. 20, the circuit configuration of (2Vtp+R) type has a zero temperature dependency at the middle of the tuning steps, and has positive/negative temperature dependency at both ends of the tuning steps.

When signal TUNEM is at level L and test mode signal TMODE is at level H, switches MSW1 and /MSW2 are turned on and switch /MSW1 is turned off. Switch MSW2 connects the gate of the transistor to node B. Switch /MSW2 is turned on only when signal TUNEM is at level L and test mode signal TMODE is at level H.

Figure 22:
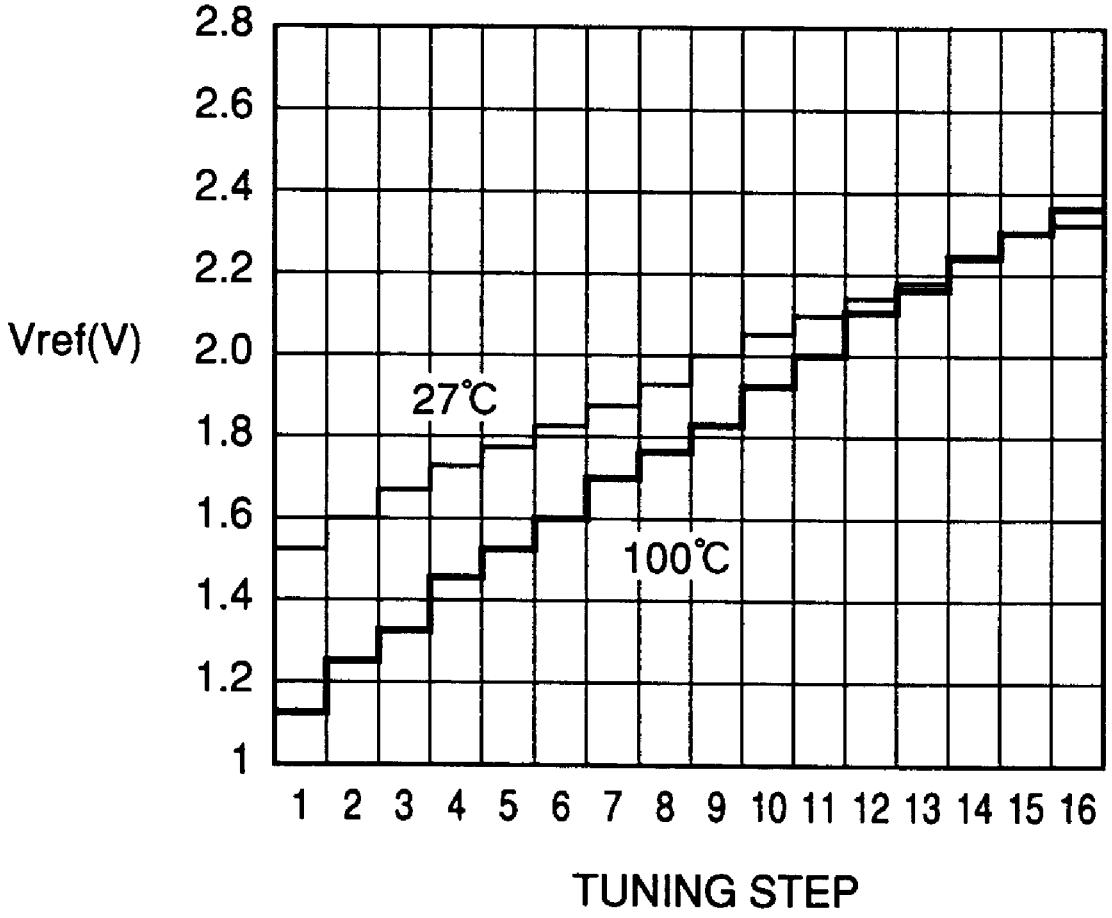
FIG. 22 PRIOR ART
FIG. 22 shows a temperature dependency of a conventional reference voltage generating circuit 4C.

In this case, reference voltage generating circuit 400 has a circuit configuration of (2Vtp+R) (2) type different from (1Vtp+R) type and (2Vtp+R) type. Therefore, tuning can be performed with the circuit configuration of (2Vtp+R) (2) type. It is noted that the circuit configuration of (2Vtp+R) (2) type has negative temperature dependency as shown in FIG. 22.

Thus, according to the fourth embodiment, total of 2 bit signals, i.e., signal TUNEM and test mode signal TMODE can be used to switch the circuit configuration to four different states. This enables tuning with three different modes, such as the circuit configuration of (1Vtp+R) type having positive temperature dependency, the circuit configuration of (2Vtp+R) type having substantially 0 temperature dependency in a middle step, and the circuit configuration of (2Vtp+R) (2) type having negative temperature dependency.

Therefore, a voltage can be tuned by switching a circuit configuration the optimal one when process variation occurs.

The switch control circuit used in the fourth embodiment can also be configured such that either the fuse element system or the tuning information system can be used by switching, as described in the third embodiment.

Fifth Embodiment

Figure 13:
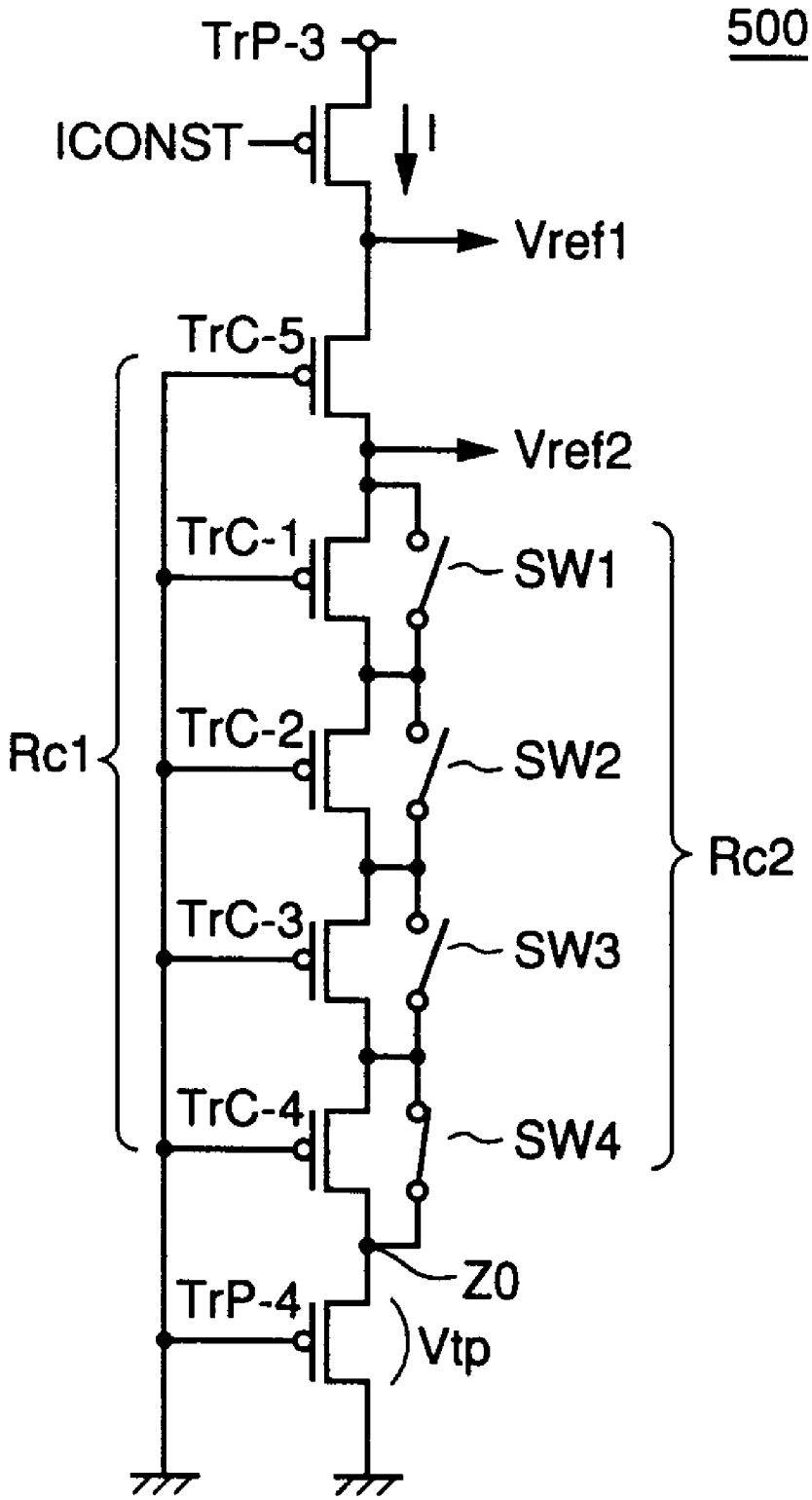
FIG. 13 is a circuit diagram showing a configuration of a reference voltage generating circuit 500 according to the fifth embodiment.

A semiconductor integrated circuit device 5000 according to the fifth embodiment is now described with reference to FIGS. 13 and 14. Semiconductor integrated circuit device 5000 includes a reference voltage generating circuit 500. Reference voltage generating circuit 500 includes, as shown in FIG. 13, transistors TrC-1 to TrC-5, TrP-3 and TrP-4, and switches SW1 to SW4.

Transistor TrP-3 is connected between a power-supply voltage and a node Vref1, and transistor TrC-5 is connected between node Vref1 and a node Vref2.

Transistors TrC-1 to TrC-4 are connected in series between node Vref2 and a node Z0, and transistor TrP-4 is connected between node Z0 and a ground voltage.

The gate of transistor TrP-3 receives a signal ICONST output from constant-current generating circuit 3, and the gates of transistors TrC-1 to TrC-5 and TrP-4 receive the ground voltage.

Switches SW1 to SW4 respectively connect/disconnect the drains and the sources of transistors TrC-1 to TrC-4.

Node Vref1 outputs a reference voltage Vref1, whereas node Vref2 outputs a reference voltage Vref2.

Reference voltage Vref1 is determined by channel resistance Rc1 which is determined by transistors TrC-1 to TrC-5, and by threshold Vtp of transistor TrP-4 (Vref1=Vtp +Rc1).

Reference voltage Vref2 is determined by channel resistance Rc2 which is determined by transistors TrC-1 to TrC-4, and by threshold Vtp of transistor TrP-4 (Vref2=Vtp+ Rc2).

Reference voltage Vref2 is smaller than reference voltage Vref1 by the amount of I×Rc5, wherein Rc5 is a channel resistance of transistor of TrC-5 and I is current flowing in transistor TrP-3.

Therefore, when the internal power-supply voltage generated based on reference voltage Vref1 is denoted by int.Vcc1, and the internal power-supply voltage generated based on reference voltage Vref2 is denoted by int. Vcc2, internal power-supply voltage int.Vccl and internal power-supply voltage int.Vcc2 at a level somewhat lower than that of internal power-supply voltage int.Vccl can be obtained.

It is noted that switch control circuits controlling switches SW1 to SW4 are not limited to particular forms. Switch control circuits 111 to 114, and 311 to 314 can be used for instance.

For example, a case is described where two types of reference voltages Vref1 and Vref2 are used as reference voltages for monitoring the level of a boost power-supply voltage.

Figure 14:
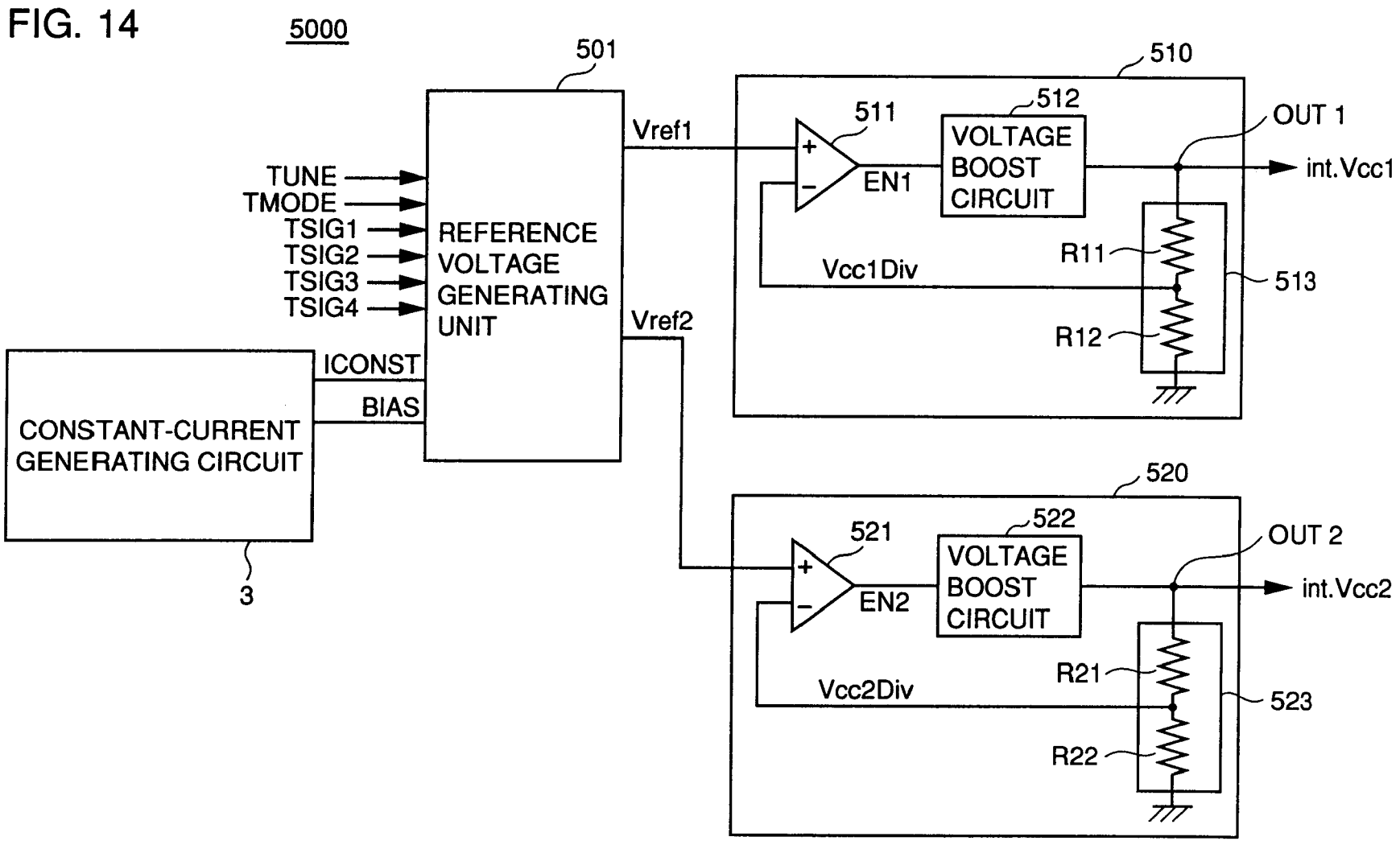
FIG. 14 is a block diagram showing a configuration of a main part of a semiconductor integrated circuit device 5000 according to the fifth embodiment.

Referring to FIG. 14, semiconductor integrated device 5000 according to the fifth embodiment includes a constant-current generating circuit 3, a reference voltage generating circuit 501 outputting reference voltages Vref1 and Vref2, and internal power-supply generating circuits 510 and 520. Internal power-supply generating circuits 510 and 520 are boost power-supply generating circuits.

Reference voltage generating circuit 501 includes a reference voltage generating circuit 500 and switch control circuits controlling on/off of switches SW1 to SW4. As an example of switch control circuits, switch control circuits 111 to 114 or 311 to 314 may be employed.

Internal power-supply generating circuit 510 includes a level monitor 511, a boost circuit 512 and a voltage dividing circuit 513.

Level monitor 511 compares reference voltage Vref1 received at a positive input terminal with an output Vcc1Div of voltage dividing circuit 513 received at a negative input terminal, and outputs an enable signal EN1 as a comparison result. Boost circuit 512 is activated in response to enable signal EN1, setting the voltage of a node OUT1 to a level higher than that of an external power-supply VCC. Node OUT1 supplies internal power-supply voltage int.Vcc1 to an internal circuit.

Voltage dividing circuit 513 includes resistors R11 and R12. Resistors R11 and R12 are connected in series between node OUT1 and a ground voltage. Output Vcc1Div can be obtained from a connecting node for resistors R11 and R12.

Internal power-supply generating circuit 520 includes a level monitor 521, a boost circuit 522 and a voltage dividing circuit 523.

Level monitor 521 compares reference voltage Vref2 received at a positive input terminal with an output Vcc2Div of voltage dividing circuit 523 received at a negative input terminal, and outputs an enable signal EN2 as a comparison result. Boost circuit 522 is activated in response to enable signal EN2, setting the voltage of node OUT2 to a level higher than that of external power-supply VCC. Node OUT2 supplies internal power-supply voltage int.Vcc2 to the internal circuit.

Voltage dividing circuit 523 has resistors R21 and R22. Resistors R21 and R22 are connected in series between node OUT2 and a ground voltage. Output Vcc2Div can be obtained from a connecting node for resistors R21 and R22.

For example, when power-supply voltage is 2.5V, internal power-supply voltage int.Vccl of 3.6V is generated, and Voltage Vcc1Div and reference voltage Vref1 are both 1.8V.

By contrast, reference voltage Vref2 has a voltage level of 1.65V, which is somewhat lower than that of reference voltage Vref1. Then, internal power-supply voltage int.Vcc2 would be 3.3V, whereas voltage Vcc2Div would be 1.65V.

In Dynamic Random Access Memory (DRAM), a boost power-supply voltage is used for a word line driver, a data line isolating circuit, a data output circuit and so forth, in order to eliminate the influence by the threshold of a transistor. Here, assuming that a power-supply for a sense amplifier detecting a potential (VCCS) of a bit line is 2.0V, and a power-supply for a peripheral circuit (VCCP) is 1.0V.

Signal control of VCCS level requires a boost power-supply voltage of (2.0V+threshold) level, so that internal power-supply voltage int.Vcc1 of 3.6V is required.

By contrast, signal control of VCCP level only requires a boost powersupply of (1.0V+threshold) level, so that internal power-supply voltage int.Vcc2 of 3.3V can satisfy the control.

Compared with generation of internal power-supply voltage int.Vccl of 3.6V from power-supply voltage VCC of 2.5V, generation of internal power-supply voltage int.Vcc2 of 3.3V from power-supply voltage VCC of 2.5V is more efficient in generating a desired level and consumes less power.

Therefore, the reference voltage generating circuit according to the fifth embodiment can generate reference voltages having two different levels, which will be particularly effective when two types of internal power-supplies are required.

Further, reference voltages Vref1 and Vref2 are generated by the same reference voltage generating circuit, so that tuning is required only once.

Further, the potential difference between reference voltages Vrefl and Vref2 will be (I×Rc5) in any tuning condition. Therefore, a stable reference voltage Vref2 can be obtained.

Channel resistance Rc1 and threshold Vtp may also have a relation shown in FIG. 1 according to the first embodiment, not limited to the relation described above. Specifically, it is also possible to use the voltage of the connecting node for transistors TrP-3 and TrC-5 as reference voltage Vref1, and the voltage of the connecting node for transistors TrC-5 and TrC-1 as reference voltage Vref2.

This enables control of the temperature dependency of reference voltages Vref1 and Vref2.

Sixth Embodiment

Figure 15:
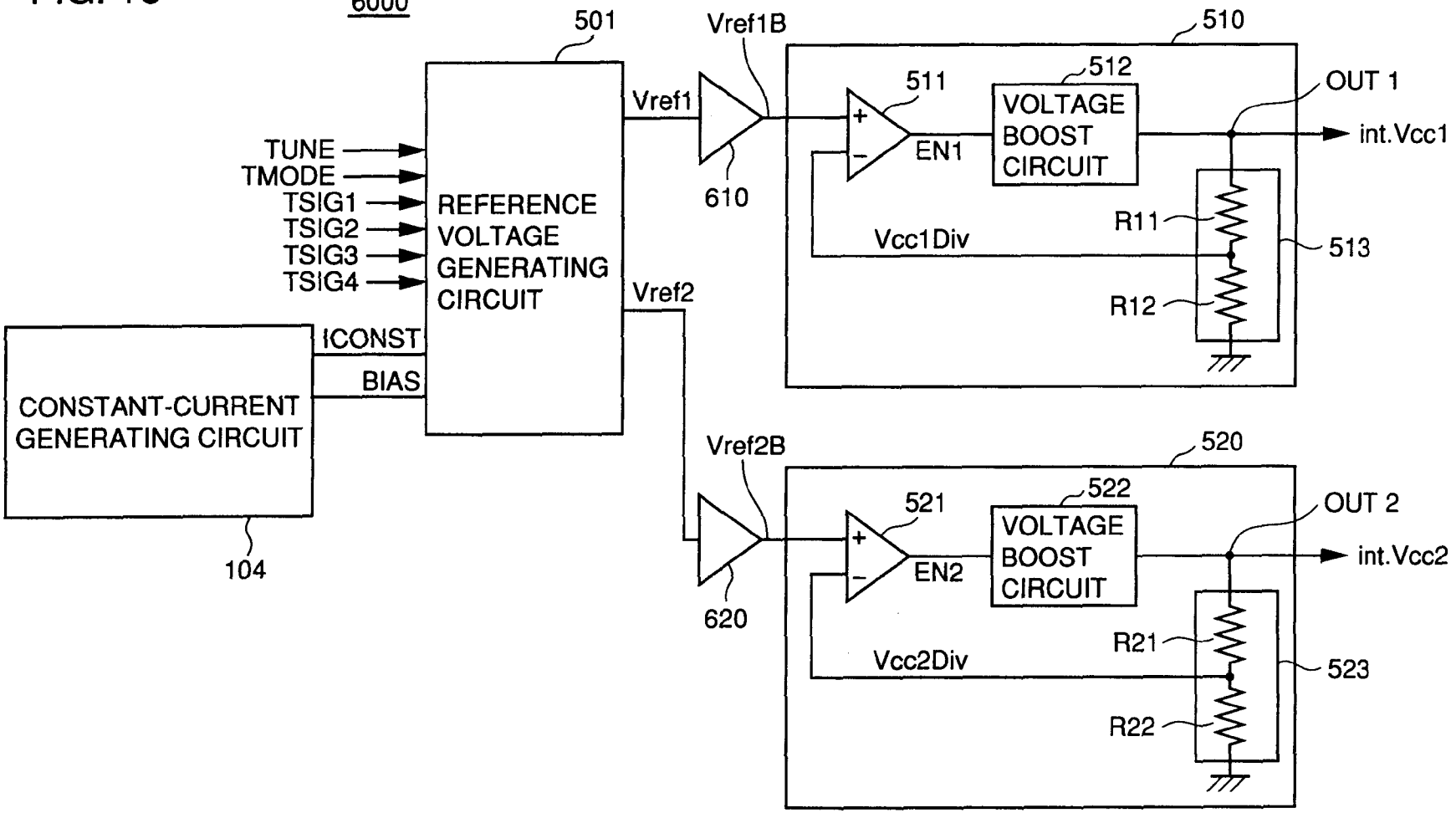
FIG. 15 is a block diagram showing a configuration of a main part of a semiconductor integrated circuit device 6000 according to the sixth embodiment.
Figure 16:
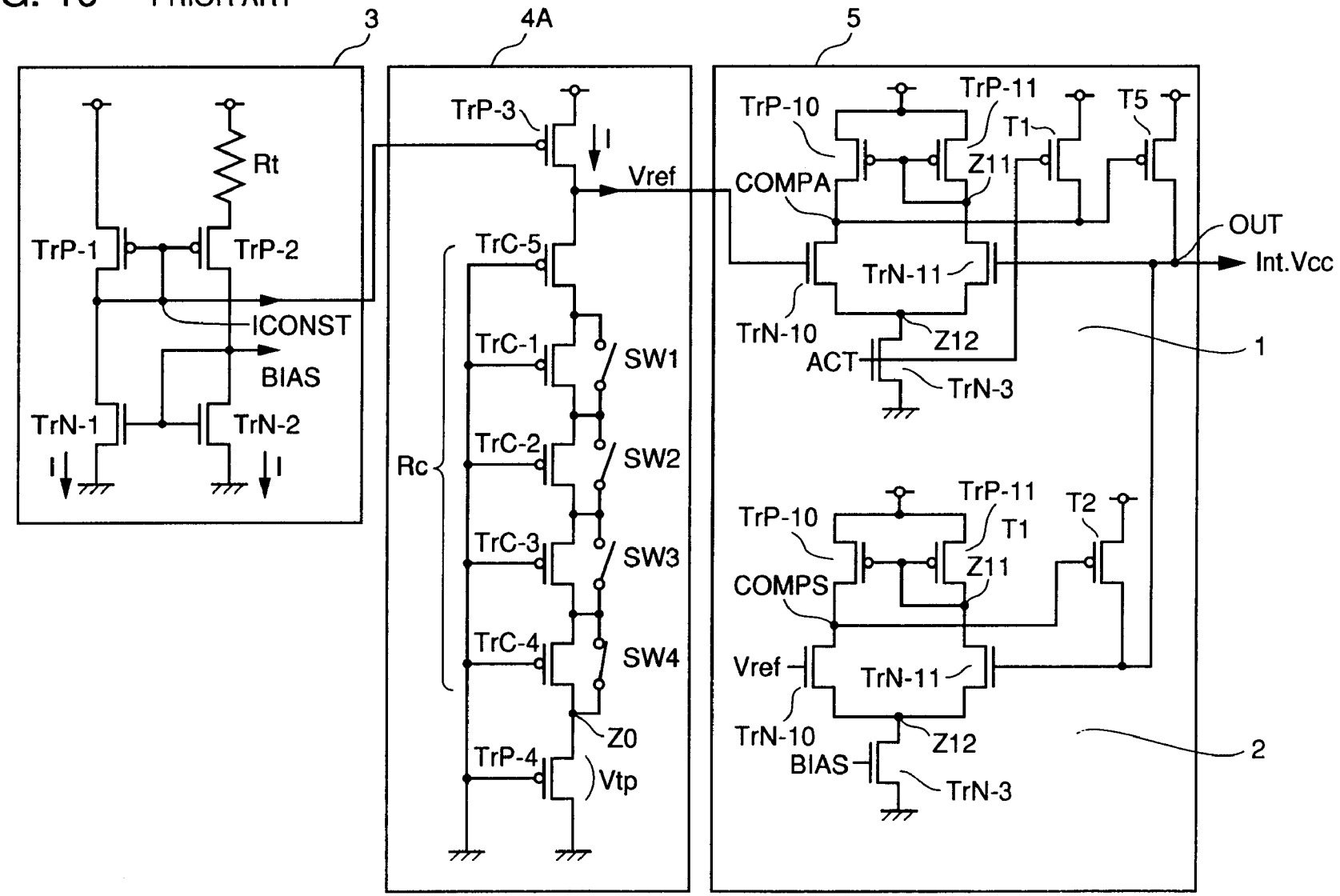
FIG. 16 PRIOR ART
FIG. 16 is a circuit diagram showing a configuration of a conventional voltage down converter.

The sixth embodiment describes an improved example of the fifth embodiment. Referring to FIG. 15, a semiconductor integrated circuit device 6000 includes a constant-current generating circuit 3, a reference voltage generating unit 501 outputting reference voltages Vref1 and Vref2, internal power-supply generating circuits 510, 520, and buffers 610, 620.

Buffer 610 is arranged between node Vrefl outputting reference voltage Vref1 and a positive input terminal of a level monitor 511. Buffer 620 is arranged between node Vref2 outputting reference voltage Vref2 and a positive input terminal of level monitor 521.

Buffer 610 buffers reference voltage Vref1 and outputs a signal Vref1B. Buffer 620 buffers reference voltage Vref and outputs a signal Vref2B.

Level monitor 511 compares signal Vref1B with signal Vcc1Div obtained by voltage dividing circuit 513. Level monitor 521 compares signal Vref 2B with signal Vcc2Div obtained by voltage dividing circuit 523.

Buffers 610 and 620 separate a system of signal Vref1B from a system of Vref2B.

A Boost power-supply generating circuit (e.g., internal power-supply generating circuits 510, 520) is not always arranged in the vicinity of a reference voltage generating circuit because of a layout limitation, and interconnections coupling each circuit may possibly be long. In such a case, the interconnection transmitting a reference voltage is susceptible to noise of neighboring interconnections. Thus, longer interconnection tends to cause variation in the reference voltage.

Further, as described above, internal power-supply voltage int.Vcc1 and internal power-supply voltage int.Vcc2 are used for different purposes, so that timing to be consumed will be different for each voltage.

When internal power-supply voltage int.Vcc1 is consumed and the voltage level of internal power-supply voltage int.Vcc1 is lowered, level monitor 511 shows a reaction. If no buffer is provided then, noise tends to be generated in signal Vref1. If the noise of signal Vref1 was received by signal Vref2, level monitor 521 to which signal Vref2 is input may malfunction. To prevent this, a buffer is provided between the level monitor and the interconnection transmitting the reference voltage, in the sixth embodiment.

Therefore, according to the sixth embodiment, buffers are respectively provided for the interconnection transmitting reference voltages Vref1 and Vref2, so that variation of reference voltage Vref2 caused by variation of signal Vref1B can be prevented, and variation of reference voltage Vref1 caused by variation of signal Vref2B can also be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor integrated circuit device, comprising:

a reference voltage generating circuit, including:

a first resistance group having a first element with a resistance value raised as temperature increases, and a first switch connected to said first element in parallel, a second resistance group having a second element with a resistance equal to or larger that the resistance value of said first element and raised as temperature increases, and a second switch connected to said second element in parallel, said second resistance group being connected to said first resistance group in series, and a third resistance group having a third element with a resistance value lowered as temperature increases, and a third switch connected to said third element in parallel, said third resistance group being connected to said first resistance group in series, said reference voltage generating circuit allowing current to flow in the resistance groups to output a reference voltage; and a control circuit rendering any one of said second and third switches conductive.

2. The semiconductor integrated circuit device according to claim 1, wherein each of said first and second elements is a channel resistance of an MOS transistor, and said third element is a resistance between a drain electrode and a source electrode of an MOS transistor while connecting the drain electrode and a gate electrode thereof with each other.

3. The semiconductor integrated circuit device according to claim 2, wherein said reference voltage generating circuit further includes:

a fourth resistance group having a fourth element with a resistance value raised as temperature increases, and a fourth switch connected to said fourth element in parallel, said fourth resistance group being connected to said first resistance group in series, and a fifth switch allowing connection between each of the gate electrodes of said first and second elements to a specified voltage or a drain voltage of said third element;

said control circuit renders any one of said fourth and fifth switches conductive.

4. A semiconductor integrated circuit device, comprising:

a reference voltage generating circuit, including:

a first resistance group having a first MOS transistor with a gate electrode connected to a specified voltage, and a first switch connected to said first MOS transistor in parallel, a second resistance group having a second MOS transistor with a gate electrode connected to said specified voltage and with a channel resistance value equal to or larger than a channel resistance value of said first MOS transistor, and a second switch connected to said second MOS transistor in parallel, said second resistance group being connected to said first resistance group in series, and a third resistance group having a third MOS transistor with a gate electrode and a drain electrode connected with each other, and a third switch connected to said third MOS transistor in parallel, said third resistance group being connected to said first resistance group in series, said reference voltage generating circuit allowing current to flow in the resistance groups to output a reference voltage; and a control circuit rendering any one of said second and third switches conductive.

* * * * *